US012359836B2

(12) United States Patent
Honda et al.

(10) Patent No.: US 12,359,836 B2
(45) Date of Patent: Jul. 15, 2025

(54) AIR-CONDITIONING APPARATUS, AND AIR DISCHARGE METHOD FOR AIR-CONDITIONING APPARATUS

(71) Applicant: Mitsubishi Electric Corporation, Tokyo (JP)

(72) Inventors: Kazuya Honda, Tokyo (JP); Naofumi Takenaka, Tokyo (JP); Yuji Motomura, Tokyo (JP); Kimitaka Kadowaki, Tokyo (JP); Koji Furuya, Tokyo (JP); Hiroki Washiyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 332 days.

(21) Appl. No.: 17/791,906

(22) PCT Filed: Mar. 4, 2020

(86) PCT No.: PCT/JP2020/009167
§ 371 (c)(1),
(2) Date: Jul. 11, 2022

(87) PCT Pub. No.: WO2021/176597
PCT Pub. Date: Sep. 10, 2021

(65) Prior Publication Data
US 2022/0404061 A1 Dec. 22, 2022

(51) Int. Cl.
*F24F 11/84* (2018.01)
*F24F 1/16* (2011.01)
*F25B 13/00* (2006.01)

(52) U.S. Cl.
CPC ..... *F24F 11/84* (2018.01); *F24F 1/16* (2013.01); *F25B 13/00* (2013.01);
(Continued)

(58) Field of Classification Search
CPC .. F25B 13/00; F25B 25/005; F25B 2313/003; F25B 2313/0231; F25B 2313/023;
(Continued)

(56) References Cited

U.S. PATENT DOCUMENTS

2013/0205818 A1* 8/2013 Morimoto ..... F24F 3/06 62/333
2013/0213324 A1* 8/2013 Saitoh ..... F01P 7/16 123/41.09

(Continued)

FOREIGN PATENT DOCUMENTS

JP 2001-336768 A 12/2001
JP 2010-101574 A 5/2010
WO 2012/107947 A1 8/2012

OTHER PUBLICATIONS

International Search Report and Written Opinion mailed on Apr. 21, 2020, received for PCT Application PCT/JP2020/009167, filed on Mar. 4, 2020, 8 pages including English Translation.

*Primary Examiner* — Jianying C Atkisson
*Assistant Examiner* — Meraj A Shaikh
(74) *Attorney, Agent, or Firm* — XSENSUS LLP

(57) ABSTRACT

The heat-medium cycle circuit includes a discharge mechanism including a discharge valve, the discharge mechanism being configured to, when the discharge valve is open, discharge air present inside the heat-medium cycle circuit to the outside of the heat-medium cycle circuit. The air-conditioning apparatus is configured to execute an air discharge operation mode in which the air present inside the heat-medium cycle circuit is discharged to the outside of the heat-medium cycle circuit. The air discharge operation mode includes a first operation mode, and a second operation mode performed after the first operation mode. The first operation mode is an operation mode in which, with the discharge valve being closed, an operation similar to a
(Continued)

cooling operation is performed. The second operation mode is an operation mode in which, with the discharge valve being open, an operation similar to a heating operation is performed.

15 Claims, 9 Drawing Sheets

(52) U.S. Cl.
CPC ..... *F25B 2600/2501* (2013.01); *F25B 2600/2515* (2013.01); *F25B 2700/19* (2013.01); *F25B 2700/2103* (2013.01)

(58) Field of Classification Search
CPC . F25B 2313/02732; F24F 11/84; F24F 3/065; F24F 1/32
See application file for complete search history.

(56) References Cited

U.S. PATENT DOCUMENTS

| | | | | |
|---|---|---|---|---|
| 2013/0269379 | A1 | 10/2013 | Ue et al. | |
| 2020/0256589 | A1* | 8/2020 | Takenaka | F25B 13/00 |
| 2020/0370208 | A1* | 11/2020 | Siewert | D01H 13/1683 |

* cited by examiner

AIR-CONDITIONING APPARATUS, AND AIR DISCHARGE METHOD FOR AIR-CONDITIONING APPARATUS

CROSS-REFERENCE TO RELATED APPLICATION

The present application is based on PCT filing PCT/JP2020/009167, filed Mar. 4, 2020, the entire contents of which are incorporated herein by reference.

TECHNICAL FIELD

The present disclosure relates to an air-conditioning apparatus including a refrigerant cycle circuit in which refrigerant circulates, and a heat-medium cycle circuit in which a heat medium circulates. The present disclosure also relates to an air discharge method with which air present inside the heat-medium cycle circuit of the air-conditioning apparatus configured as described above is discharged to the outside of the heat-medium cycle circuit.

BACKGROUND ART

Some conventional air-conditioning apparatuses employ a direct-expansion system, Such a direct-expansion air-conditioning apparatus includes a refrigerant cycle circuit in which a heat source-side heat exchanger and a use-side heat exchanger are connected by a pipe. Refrigerant is circulated between the heat source-side heat exchanger and the use-side heat exchanger. In charging refrigerant into the refrigerant cycle circuit of the direct-expansion air-conditioning apparatus, prior to the charging of the refrigerant, the inside of the refrigerant cycle circuit is pulled into a vacuum to thereby discharge air present inside the refrigerant cycle circuit.

Some conventional air-conditioning apparatuses employ an indirect system. Such an indirect air-conditioning apparatus includes a refrigerant cycle circuit in which refrigerant circulates, and a heat-medium cycle circuit in which a heat medium circulates, Examples of the heat medium include water and an antifreeze. The heat medium differs from the refrigerant that circulates in the refrigerant cycle circuit. The refrigerant cycle circuit includes a heat source-side heat exchanger, and generates cooling energy and heating energy. The cooling energy and the heating energy that are generated by the refrigerant cycle circuit are supplied to the heat medium in the heat-medium cycle circuit via an intermediate heat exchanger. The heat-medium cycle circuit includes a use-side heat exchanger. The cooling energy and the heating energy that are supplied from the refrigerant cycle circuit to the heat medium in the heat-medium cycle circuit are used in the use-side heat exchanger to provide indoor air-conditioning.

In charging a heat medium into the heat-medium cycle circuit of the conventional indirect air-conditioning apparatus, the air inside the heat-medium cycle circuit is pushed out by the heat medium being charged. However, this method may, in some cases, cause an air parcel to stay inside the heat-medium cycle circuit. If air stays inside the heat-medium cycle circuit for an extended period of time, this may accelerate corrosion of a pipe constituting the heat-medium cycle circuit. If a large amount of air stays inside the heat-medium cycle circuit, this may cause damage to a pipe used to circulate the heat medium inside the heat-medium cycle circuit, which may lead to reduced lifetime of the pump. For this reason, it is preferred for indirect air-conditioning apparatuses to minimize the amount of air that stays inside the heat-medium cycle circuit. Accordingly, some conventional proposed indirect air-conditioning apparatuses are designed such that, in charging a heat medium into the heat-medium cycle circuit, the rotation speed and rotation direction of the pump are varied to stir the heat medium for efficient discharge of an air parcel from inside the heat-medium cycle circuit (see Patent Literature 1).

CITATION LIST

Patent Literature

Patent Literature Japanese Unexamined Patent Application Publication No. 2001-336768

SUMMARY OF INVENTION

Technical Problem

Air present inside the heat-medium cycle circuit includes not only air that exists as an air parcel but also air that has been dissolved in the heat medium since the charging of the heat medium into the heat-medium cycle circuit. In this regard, the air-conditioning apparatus described in Patent Literature 1 does not allow discharge of air dissolved in the heat medium to the outside of the heat-medium cycle circuit. Thus, the air-conditioning apparatus described in Patent Literature 1 is still inadequate in terms of its ability to discharge air present inside the heat-medium cycle circuit to the outside of the heat-medium cycle circuit.

The present disclosure is directed to addressing the above-mentioned problem, and accordingly it is an object of the present disclosure to provide an air-conditioning apparatus that allows for greater discharge of air present inside the heat-medium cycle circuit to the outside of the heat-medium cycle circuit than is currently possible. Further, the present disclosure is directed to addressing the above-mentioned problem, and accordingly it is another object of the present disclosure to provide an air discharge method for an air-conditioning apparatus, the air discharge method allowing for greater discharge of air present inside the heat-medium cycle circuit to the outside of the heat-medium cycle circuit than is currently possible.

Solution to Problem

According to an embodiment of the present disclosure, there is provided an air-conditioning apparatus including an intermediate heat exchanger, a refrigerant cycle circuit, a heat-medium cycle circuit, and a discharge mechanism. The intermediate heat exchanger includes a first heat transfer unit in which refrigerant flows, and a second heat transfer unit in which a heat medium different from the refrigerant flows. The intermediate heat exchanger is configured to exchange heat between the first heat transfer unit and the second heat transfer unit. The refrigerant cycle circuit includes a heat source-side heat exchanger. The heat source-side heat exchanger is connected with the first heat transfer unit by a pipe. The refrigerant cycle circuit is configured to allow the refrigerant to circulate inside the refrigerant cycle circuit. The heat-medium cycle circuit includes a use-side heat exchanger. The use-side heat exchanger is connected with the second heat transfer unit by a pipe. The heat-medium cycle circuit is configured to allow the heat medium to circulate inside the heat-medium cycle circuit. The discharge mechanism is provided at the heat-medium cycle circuit, and includes a discharge valve. The discharge mechanism is configured to, when the discharge valve is open, discharge air present inside the heat-medium cycle circuit to an outside of the heat-medium cycle circuit. The air-conditioning apparatus is configured to execute an air discharge operation mode in which the air present inside the heat-medium cycle circuit is discharged to the outside of the heat-medium cycle circuit. The air discharge operation mode includes a first operation mode, and a second operation mode performed after the first operation mode. The first operation mode is an operation mode in which, with the heat source-side heat exchanger functioning as a radiator, and with the first heat transfer unit functioning as an evaporator, the refrigerant circulates in the refrigerant cycle circuit, and in which, with the discharge valve of the discharge mechanism being closed, the heat medium circulates in the heat-medium cycle circuit. The second operation mode is an operation mode in which, with the heat source-side heat exchanger functioning as an evaporator, and with the first heat transfer unit functioning as a radiator, the refrigerant circulates in the refrigerant cycle circuit, and in which, with the discharge valve of the discharge mechanism being open, the heat medium circulates in the heat-medium cycle circuit.

According to an embodiment of the present disclosure, there is provided an air discharge method for an air-conditioning apparatus. The air-conditioning apparatus includes an intermediate heat exchanger, a refrigerant cycle circuit, a heat-medium cycle circuit, and a discharge mechanism. The intermediate heat exchanger includes a first heat transfer unit in which refrigerant flows, and a second heat transfer unit in which a heat medium different from the refrigerant flows. The intermediate heat exchanger is configured to exchange heat between the first heat transfer unit and the second heat transfer unit. The refrigerant cycle circuit includes a heat source-side heat exchanger. The heat source-side heat exchanger is connected with the first heat transfer unit by a pipe. The refrigerant cycle circuit is configured to allow the refrigerant to circulate inside the refrigerant cycle circuit. The heat-medium cycle circuit includes a use-side heat exchanger. The use-side heat exchanger is connected with the second heat transfer unit by a pipe. The heat-medium cycle circuit is configured to allow the heat medium to circulate inside the heat-medium cycle circuit. The discharge mechanism is provided at the heat-medium cycle circuit, and includes a discharge valve. The discharge mechanism is configured to, when the discharge valve is open, discharge air present inside the heat-medium cycle circuit to an outside of the heat-medium cycle circuit. The air discharge method for the air-conditioning apparatus is a method for discharging the air present inside the heat-medium cycle circuit to the outside of the heat-medium cycle circuit. The air discharge method includes a first process, and a second process performed after the first process. The first process is a process of, with the heat source-side heat exchanger functioning as a radiator, and with the first heat transfer unit functioning as an evaporator, circulating the refrigerant in the refrigerant cycle circuit, and with the discharge valve of the discharge mechanism being closed, circulating the heat medium in the heat-medium cycle circuit. The second process is a process of, with the heat source-side heat exchanger functioning as an evaporator, and with the first heat transfer unit functioning as a radiator, circulating the refrigerant in the refrigerant cycle circuit, and with the discharge valve of the discharge mechanism being open, circulating the heat medium in the heat-medium cycle circuit.

Advantageous Effects of Invention

With the air-conditioning apparatus according to an embodiment of the present disclosure, in the first operation mode, an air parcel present inside the heat-medium cycle circuit can be dissolved into the heat medium. Further, with the air-conditioning apparatus according to an embodiment of the present disclosure, in the second operation mode, air that has been dissolved in the heat medium can be released from the heat medium, and the air released from the heat medium can be discharged through the discharge mechanism to the outside of the heat-medium cycle circuit. Consequently, with the air-conditioning apparatus according to art embodiment of the present disclosure, an air parcel present inside the heat-medium cycle circuit, and air that has been dissolved in the heat medium since the charging of the heat medium into the heat-medium cycle circuit can be both discharged to the outside of the heat-medium cycle circuit. Therefore, the air-conditioning apparatus according to an embodiment of the present disclosure allows for greater discharge of air present inside the heat-medium cycle circuit to the outside of the heat-medium cycle circuit than is conventionally possible.

Likewise, with the air discharge method for an air-conditioning apparatus according to an embodiment of the present disclosure, in the first process, an air parcel present inside the heat-medium cycle circuit can be dissolved into the heat medium. Further, with the air discharge method for an air-conditioning apparatus according to an embodiment of the present disclosure, in the second process, air that has been dissolved in the heat medium can be released from the heat medium, and the air released from the heat medium can be discharged through the discharge mechanism to the outside of the heat-medium cycle circuit. Consequently, with the air discharge method for an air-conditioning apparatus according to an embodiment of the present disclosure, an air parcel present inside the heat-medium cycle circuit, and air that has been dissolved in the heat medium since the charging of the heat medium into the heat-medium cycle circuit can be both discharged to the outside of the heat-medium cycle circuit. Therefore, the air discharge method for an air-conditioning apparatus according to an embodiment of the present disclosure allows for greater discharge of air present inside the heat-medium cycle circuit to the outside of the heat-medium cycle circuit than is conventionally possible.

DESCRIPTION OF EMBODIMENTS

Embodiment 1

Figure 1:
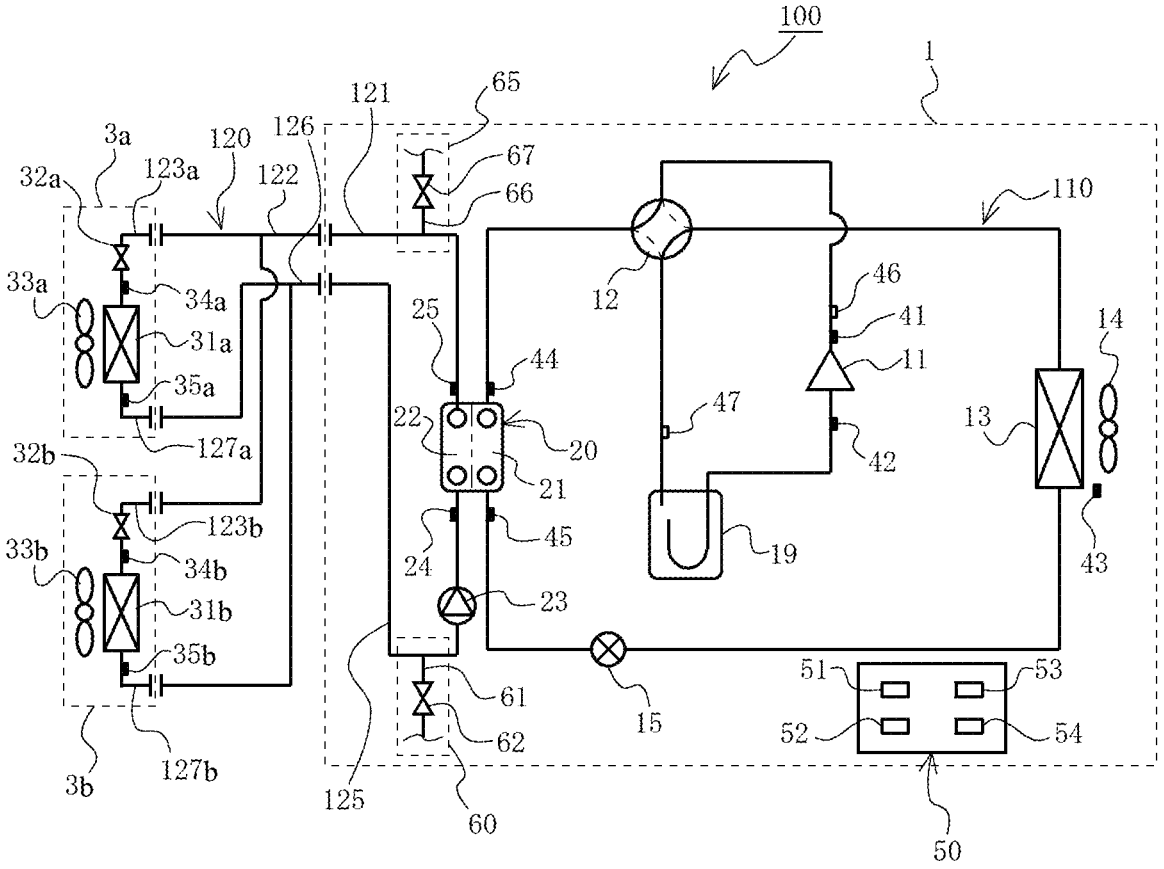
FIG. 1 schematically illustrates an exemplary circuit configuration of an air conditioning apparatus according to Embodiment 1.

FIG. 1 schematically illustrates an exemplary circuit configuration of an air conditioning apparatus according to Embodiment 1.

An air-conditioning apparatus 100 according to Embodiment 1 includes a heat source unit 1, and an indoor unit. The heat source unit 1 is installed, for example, outside a room. The heat source unit 1 discharges heat absorbed from indoor air during cooling operation to the outside of a room. The heat source unit 1 also supplies heat to the indoor unit during heating operation. The indoor unit supplies conditioned air to an indoor space. In the example illustrated in FIG. 1, the air-conditioning apparatus 100 includes, as the indoor unit, an indoor unit 3*a* and an indoor unit 3*b*. The indoor unit 3*a* and the indoor unit 3*b* are connected in parallel with the heat source unit 1. The air-conditioning apparatus 100 may not necessarily include two indoor units. Alternatively, the air-conditioning apparatus 100 may include a single indoor unit, or may include three or more indoor units.

The air-conditioning apparatus 100 includes an intermediate heat exchanger 20, a refrigerant cycle circuit 110, and a heat-medium cycle circuit 120. The intermediate heat exchanger 20 includes a first heat transfer unit 21 in which refrigerant flows, and a second heat transfer unit 22 in which a heat medium different from the refrigerant flows. The intermediate heat exchanger 20 is configured to exchange heat between the first heat transfer unit 21 and the second heat transfer unit 22. Examples of the heat medium include water and antifreeze.

The refrigerant cycle circuit 110 includes a heat source-side heat exchanger 13. The heat source-side heat exchanger 13 of the refrigerant cycle circuit 110 is connected with the first heat transfer unit 21 of the intermediate heat exchanger 20 by a pipe. Refrigerant circulates inside the refrigerant cycle circuit 110. The heat-medium cycle circuit 120 includes a use-side heat exchanger. The use-side heat exchanger of the heat-medium cycle circuit 120 is connected with the second heat transfer unit 22 of the intermediate heat exchanger 20 by a pipe. The heat medium circulates inside the heat-medium cycle circuit 120. As will be described later, the use-side heat exchanger is accommodated in the indoor unit. As described above, the air-conditioning apparatus 100 includes, as the indoor unit, the indoor unit 3*a* and the indoor unit 3*b*. Accordingly, the air-conditioning apparatus 100 according to Embodiment 1 includes, as the use-side heat exchanger, a use-side heat exchanger 31*a* accommodated in the indoor unit 3*a*, and a use-side heat exchanger 31*b* accommodated in the indoor unit 3*b*. The use-side heat exchanger 31*a* and the use-side heat exchanger 31*b* are connected in parallel with the second heat transfer unit 22 of the intermediate heat exchanger 20.

More specifically, according to Embodiment 1, the refrigerant cycle circuit 110 is configured as described below. The refrigerant cycle circuit 110 includes a compressor 11, a flow switching device 12, the heat source-side heat exchanger 13, an expansion device 15, and an accumulator 19. The compressor 11, the flow switching device 12, the heat source-side heat exchanger 13, the expansion device 15, the accumulator 19, and the first heat transfer unit 21 of the intermediate heat exchanger 20 are connected by pipes to form the refrigerant cycle circuit 110.

The compressor 11 sucks and compresses refrigerant into a high-temperature, high-pressure state. The compressor 11 is, for example, an inverter compressor whose capacity can be controlled. The compressor 11 may have a low-pressure shell structure, or may have a high-pressure shell structure. The compressor 11 with a low-pressure shell structure is designed such that a hermetic vessel is filled with low-pressure refrigerant, and the low-pressure refrigerant inside the hermetic vessel is sucked and compressed. The compressor 11 with a high-pressure shell structure is designed such that a compression mechanism unit sucks low-pressure refrigerant from a pipe connected with the compression mechanism unit, and a hermetic vessel is filled with the refrigerant compressed by the compression mechanism unit.

The flow switching device 12 switches between the flow path of refrigerant during cooling operation, and the flow path of refrigerant during heating operation. More specifically, during cooling operation, the flow switching device 12 switches to a flow path as represented by dashed lines in FIG. 1, that is, a flow path in which the discharge outlet of the compressor 11 is connected with the heat source-side heat exchanger 13 and in which the suction inlet of the compressor 11 is connected with the first heat transfer unit 21 of the intermediate heat exchanger 20. As a result, the heat source-side heat exchanger 13 functions as a radiator, and the first heat transfer unit 21 of the intermediate heat exchanger 20 functions as an evaporator. If the refrigerant that circulates in the refrigerant cycle circuit 110 is one that condenses in the radiator, the radiator is sometimes referred to also as condenser. During heating operation, the flow switching device 12 switches to a flow path as represented by solid lines in FIG. 1, that is, a flow path in which the discharge outlet of the compressor 11 is connected with the first heat transfer unit 21 of the intermediate heat exchanger 20 and in which the suction inlet of the compressor 11 is connected with the heat source-side heat exchanger 13, As a result, the first heat transfer unit 21 of the intermediate heat exchanger 20 functions as a radiator, and the heat source-side heat exchanger 13 functions as an evaporator. That is, during cooling operation, the refrigerant flowing in the first heat transfer unit 21 of the intermediate heat exchanger 20 removes heat from the heat medium flowing in the second heat transfer unit 22 of the intermediate heat exchanger 20 to thereby cool the heat medium flowing in the second heat transfer unit 22. During heating operation, the refrigerant flowing in the first heat transfer unit 21 of the intermediate heat exchanger 20 rejects heat to the heat medium flowing in the second heat transfer unit 22 of the intermediate heat exchanger 20 to thereby heat the heat medium flowing in the second heat transfer unit 22. Although the flow switching device 12 is, for example, a four-way valve in Embodiment 1, the flow switching device 12 may be, for example, a two-way valve.

A fan 14 is disposed near the heat source-side heat exchanger 13 to supply outdoor air to the heat source-side heat exchanger 13, Refrigerant flowing in the heat source-side heat exchanger 13 exchanges heat with the outdoor air supplied from the fan 14. The expansion device 15 is disposed between the heat source-side heat exchanger 13, and the first heat transfer unit 21 of the intermediate heat exchanger 20 to reduce the pressure of refrigerant exiting the radiator to thereby cause the refrigerant to expand. The accumulator 19 is disposed between the suction inlet of the compressor 11, and the evaporator. The accumulator 19 is configured to store excess refrigerant. Such excess refrigerant results from, for example, the difference in the rate at which refrigerant circulates in the refrigerant cycle circuit 110 during cooling operation, and the rate at which refrigerant circulates in the refrigerant cycle circuit 110 during heating operation. Such excess refrigerant also results from, for example, transient changes in operating state during cooling operation and during heating operation. The excess refrigerant stored in the accumulator 19 is at a low pressure. Instead of the accumulator 19, a receiver for storing high-pressure excess refrigerant may be provided at the refrigerant cycle circuit 110.

Detailed reference is made below to how the heat-medium cycle circuit 120 is configured in accordance with Embodiment 1. The heat-medium cycle circuit 120 incudes a pump 23, the use-side heat exchanger 31*a*, the use-side heat exchanger 31*b*, a flow control valve 32*a*, and a flow control valve 32*b*, The pump 23, the use-side heat exchanger 31*a*, the use-side heat exchanger 31*b*, the flow control valve 32*a*, the flow control valve 32*b*, and the second heat transfer unit 22 of the intermediate heat exchanger 20 are connected by pipes to form the heat-medium cycle circuit 120.

The pump 23 causes the heat medium inside the heat-medium cycle circuit 120 to circulate. That is, in the heat-medium cycle circuit 120, the pump 23 sucks and pressurizes the heat medium, and discharges the pressurized heat medium. The pump 23 is configured such that, for example, the driving frequency of the pump 23 can be varied within a predetermined range to vary the flow rate of the heat medium discharged from the pump 23. According to Embodiment 1, the pump 23 is disposed near the heat-medium inlet of the intermediate heat exchanger 20. More specifically, a pipe 125 is connected with the heat-medium inlet of the second heat transfer unit 22 of the intermediate heat exchanger 20. The pump 23 is provided at the pipe 125. That is, according to Embodiment 1, the heat medium discharged from the pump 23 flows into the second heat transfer unit 22 of the intermediate heat exchanger 20.

The use-side heat exchanger 31*a* and the use-side heat exchanger 31*b* each generate conditioned air that is to be supplied indoors.

The heat-medium inlet of the use-side heat exchanger 31*a* is connected with the heat-medium outlet of the second heat transfer unit 22 of the intermediate heat exchanger 20 via a pipe 121, a pipe 122, and a pipe 123*a*. Of the pipes connecting the heat-medium inlet of the use-side heat exchanger 31*a* with the heat-medium outlet of the second heat transfer unit 22, the pipe 121 is a pipe that is accommodated in the heat source unit 1. Of the pipes connecting the heat-medium inlet of the use-side heat exchanger 31*a* with the heat-medium outlet of the second heat transfer unit 22, the pipe 122 is a pipe that is disposed outside the heat source unit 1 and the indoor unit 3*a*. The pipe 121 and the pipe 122 are connected with each other by a coupling provided at the heat source unit 1. Of the pipes connecting the heat-medium inlet of the use-side heat exchanger 31*a* with the heat-medium outlet of the second heat transfer unit 22, the pipe 123*a* is a pipe that is accommodated in the indoor unit 3*a*. The pipe 123*a* and the pipe 122 are connected with each other by a coupling provided at the indoor unit 3*a*.

The heat-medium outlet of the use-side heat exchanger 31*a* is connected with the heat-medium inlet of the second heat transfer unit 22 of the intermediate heat exchanger 20 via the pipe 125, a pipe 126, and a pipe 127*a*. Of the pipes connecting the heat-medium outlet of the use-side heat exchanger 31*a* with the heat-medium inlet of the second heat transfer unit 22, the pipe 125 is a pipe that is accommodated in the heat source unit 1. Of the pipes connecting the heat-medium outlet of the use-side heat exchanger 31*a* with the heat-medium inlet of the second heat transfer unit 22 the pipe 126 is a pipe that is disposed outside the heat source unit 1 and the indoor unit 3*a*. The pipe 125 and the pipe 126 are connected with each other by a coupling provided at the heat source unit 1. Of the pipes connecting the heat-medium outlet of the use-side heat exchanger 31*a* with the heat-medium inlet of the second heat transfer unit 22, the pipe 127*a* is a pipe that is accommodated in the indoor unit 3*a*. The pipe 127*a* and the pipe 126 are connected with each other by a coupling provided at the indoor unit 3*a*.

A fan 33*a* is disposed near h use-side heat exchanger 31*a* to supply indoor air to the use-side heat exchanger 31*a*.

Accordingly, during cooling operation, refrigerant cooled in the second heat transfer unit 22 of the intermediate heat exchanger 20 passes through the pipe 121, the pipe 122, and the pipe 123*a* into the use-side heat exchanger 31*a*. As indoor air supplied from the fan 33*a* passes through the use-side heat exchanger 31*a*, the indoor air is cooled by the heat medium flowing in the use-side heat exchanger 31*a*, and turns into conditioned air. The conditioned air then leaves the use-side heat exchanger 31*a*, and returns indoors. Meanwhile, the heat medium heated by the indoor air when flowing through the use-side heat exchanger 31*a* passes through the pipe 127*a*, the pipe 126, and the pipe 125, and returns to the second heat transfer unit 22 of the intermediate heat exchanger 20.

During heating operation, refrigerant heated in the second heat transfer unit 22 of the intermediate heat exchanger 20 passes through the pipe 121 the pipe 122, and the pipe 123*a* into the use-side heat exchanger 31*a*. As indoor air supplied from the fan 33*a* passes through the use-side heat exchanger 31*a*, the indoor air is heated by the heat medium flowing in the use-side heat exchanger 31*a*, and turns into conditioned air. The conditioned air then leaves the use-side heat exchanger 31*a*, and returns indoors. Meanwhile, the heat medium cooled by the indoor air when flowing through the use-side heat exchanger 31*a* passes through the pipe 127*a*, the pipe 126, and the pipe 125, and returns to the second heat transfer unit 22 of the intermediate heat exchanger 20.

The heat-medium inlet of the use-side heat exchanger 31*b* is connected with the heat-medium outlet of the second heat transfer unit 22 of the intermediate heat exchanger 20 via the pipe 121, the pipe 122, and a pipe 123*b*. Of the pipes connecting the heat-medium inlet of the use-side heat exchanger 31*b* with the heat-medium outlet of the second heat transfer unit 22, the pipe 123*b* is a pipe that is accommodated in the indoor unit 3*b*. The pipe 123*b* and the pipe 122 are connected with each other by a coupling provided at the indoor unit 3*b*. The pipe 123*b* and the pipe 123*a* are connected in parallel with the pipe 122.

The heat-medium outlet of the use-side heat exchanger 31*b* is connected with the heat-medium inlet of the second heat transfer unit 22 of the intermediate heat exchanger 20 via the pipe 125, the pipe 126, and a pipe 127*b*. Of the pipes connecting the heat-medium outlet of the use-side heat exchanger 31*b* with the heat-medium inlet of the second heat transfer unit 22, the pipe 127*b* is a pipe that is accommodated in the indoor unit 3*b*. The pipe 127*b* and the pipe 126 are connected with each other by a coupling provided at the indoor unit 3*b*. The pipe 127*b* and the pipe 127*a* are connected in parallel with the pipe 126.

A fan 33*b* is disposed near the use-side heat exchanger 31*b* to supply indoor air to the use-side heat exchanger 31*b*.

Accordingly during cooling operation, refrigerant cooled in the second heat transfer unit 22 of the intermediate heat exchanger 20 passes through the pipe 121, the pipe 122, and the pipe 123*b* into the use-side heat exchanger 31*b*, As indoor air supplied from the fan 33*b* passes through the use-side heat exchanger 31*b*, the indoor air is cooled by the heat medium flowing in the use-side heat exchanger 31*b*, and turns into conditioned air. The conditioned air then leaves the use-side heat exchanger 31*b*, and returns indoors. Meanwhile, the heat medium heated by the indoor air when flowing through the use-side heat exchanger 31*b* passes through the pipe 127*b*, the pipe 126, and the pipe 125, and returns to the second heat transfer unit 22 of the intermediate heat exchanger 20.

During heating operation, refrigerant heated in the second heat transfer unit 22 of the intermediate heat exchanger 20 passes through the pipe 121 the pipe 122, and the pipe 123*b* into the use-side heat exchanger 31*b*. As indoor air supplied from the fan 33*b* passes through the use-side heat exchanger 31*b*, the indoor air is heated by the heat medium flowing in the use-side heat exchanger 31*b*, and turns into conditioned air. The conditioned air then leaves the use-side heat exchanger 31*b*, and returns indoors. Meanwhile, the heat medium cooled by the indoor air when flowing through the use-side heat exchanger 31*b* passes through the pipe 127*b*, the pipe 126, and the pipe 125, and returns to the second heat transfer unit 22 of the intermediate heat exchanger 20.

The flow control valve 32*a* controls the flow rate of the heat medium entering the use-side heat exchanger 31*a*. The flow control valve 32*a* is, for example, a two-way valve whose opening degree can be adjusted. According to Embodiment 1, the flow control valve 32*a* is provided at the pipe 123*a*, which is connected with the heat-medium inlet of the use-side heat exchanger 31*a*. Alternatively, the flow control valve 32*a* may be provided at the pipe 127*a*, which is connected with the heat-medium outlet of the use-side heat exchanger 31*a*. The flow control valve 32*b* controls the flow rate of the heat medium entering the use-side heat exchanger 31*b*. The flow control valve 32*b* is, for example, a two-way valve whose opening degree can be adjusted. According to Embodiment 1, the flow control valve 32*b* is provided at the pipe 123*b*, which is connected with the heat-medium inlet of the use-side heat exchanger 31*b*. Alternatively, the flow control valve 32*a* may be provided at the pipe 127*b*, which is connected with the heat-medium outlet of the use-side heat exchanger 31*b*.

That is, in the air-conditioning apparatus 100 according to Embodiment 1, a set of the use-side heat exchanger 31*a* and the flow control valve 32*a*, and a set of the use-side heat exchanger 31*b* and the flow control valve 32*b* are connected in parallel with each other in the heat-medium cycle circuit 120, In other words, the air-conditioning apparatus 100 includes a plurality of sets of a use-side heat exchanger and a flow control valve, which is a valve configured to control the flow rate of the heat medium entering the use-side heat exchanger. These sets are connected in parallel with each other in the heat-medium cycle circuit 120.

The air-conditioning apparatus 100 includes a supply mechanism 60, and a discharge mechanism 65. The supply mechanism 60 is provided at the heat-medium cycle circuit 120. The supply mechanism 60 is used in charging the heat medium into the heat-medium cycle circuit 120 during, for example, installation of the air-conditioning apparatus 100. The supply mechanism 60 includes a supply pipe 61, and a supply valve 62. The supply pipe 61 is connected with the heat-medium cycle circuit 120. The supply pipe 61 is connected to a heat-medium supply source when the heat medium is to be charged into the heat-medium cycle circuit 120. For example, if the heat medium is water, the supply pipe 61 is connected to a water supply. The supply valve 62 is, for example, an open/close valve provided at the supply pipe 61 and capable of opening and closing the flow path inside the supply pipe 61. That is, when the supply valve 62 opens, the heat medium is charged into the heat-medium cycle circuit 120 through the supply pipe 61. When the supply valve 62 closes, the charging of the heat medium into the heat-medium cycle circuit 120 ends. As described above, the pipe 125 is connected with the heat-medium inlet of the second heat transfer unit 22 of the intermediate heat exchanger 20. According to Embodiment 1, the supply mechanism 60 is provided at the pipe 125. More specifically, according to Embodiment 1, the supply mechanism 60 is provided at the pipe 125 at a location near the suction side of the pump 23.

The discharge mechanism 65 is provided at the heat-medium cycle circuit 120 to discharge air present inside the heat-medium cycle circuit 120 to the outside of the heat-medium cycle circuit 120. The discharge mechanism 65 includes a discharge pipe 66, and a discharge valve 67. The discharge pipe 66 is connected with the heat-medium cycle circuit 120. The discharge valve 67 is provided at the discharge pipe 66. The discharge valve 67 is capable of discharging air flowing into the discharge pipe 66 from inside the heat-medium cycle circuit 120. That is, when the discharge valve 67 opens, air present inside the heat-medium cycle circuit 120 is discharged to the outside of the heat-medium cycle circuit 120 through the discharge pipe 66, When the discharge valve 67 closes, the discharge of air from the heat-medium cycle circuit 120 ends. That is, the discharge mechanism 65 is configured to, when the discharge valve 67 is open, discharge air present inside the heat-medium cycle circuit 120 to the outside of the heat-medium cycle circuit 120. As described above, the pipe 121 is connected with the heat-medium outlet of the second heat transfer unit 22 of the intermediate heat exchanger 20. According to Embodiment 1, the discharge mechanism 65 is provided at the pipe 121.

The above-mentioned components of the air-conditioning apparatus 100 are accommodated in the heat source unit 1, the indoor unit 3*a*, or the indoor unit 3*b*. The components of the refrigerant cycle circuit 110 are accommodated in the heat source unit 1. More specifically, the compressor 11, the flow switching device 12, the heat source-side heat exchanger 13, the expansion device 15, and the accumulator 19 are accommodated in the heat source unit 1. Further, the fan 14, the intermediate heat exchanger 20, the supply mechanism 60, and the discharge mechanism 65 are accommodated in the heat source unit 1. Of the components of the heat-medium cycle circuit 120, the pump 23 is accommodated in the heat source unit 1. The components of the heat-medium cycle circuit 120 other than the pump 23 are accommodated in the indoor unit 3*a* or the indoor unit 3*b*. More specifically, the use-side heat exchanger 31*a* and the flow control valve 32*a* are accommodated in the indoor unit 3*a*. The use-side heat exchanger 31*b* and the flow control valve 32*b* are accommodated in the indoor unit 3*b*. The fan 33*a* is accommodated in the indoor unit 3*a*, and the fan 33*b* is accommodated in the indoor unit 3*b*.

The air-conditioning apparatus 100 according to Embodiment 1 includes various sensors, and a controller 50 configured to, based on values detected by these sensors, control the components of the air-conditioning apparatus 100.

For example, the air-conditioning apparatus 100 includes the following sensors provided at the heat source unit 1: a first temperature sensor 24, a second temperature sensor 25, a temperature sensor 41, a temperature sensor 42, a temperature sensor 43, a temperature sensor 44, a temperature sensor 45, a pressure sensor 46, and a pressure sensor 47.

The first temperature sensor 24 is, for example, a thermistor, and detects the temperature of the heat medium that enters the second heat transfer unit 22 of the intermediate heat exchanger 20. The second temperature sensor 25 is, for example, a thermistor, and detects the temperature of the heat medium that exits the second heat transfer unit 22 of the intermediate heat exchanger 20. The temperature sensor 41 is, for example, a thermistor, and detects the temperature of refrigerant that is discharged from the compressor 11. The temperature sensor 42 is, for example, a thermistor, and detects the temperature of refrigerant that is sucked into the compressor 11, The temperature sensor 43 is, for example, a thermistor, and detects the temperature of outdoor air that is supplied to the heat source-side heat exchanger 13.

The temperature sensor 44 is, for example, a thermistor. The temperature sensor 44 is configured to, during cooling operation, detect the temperature of refrigerant that exits the first heat transfer unit 21 of the intermediate heat exchanger 20. The temperature sensor 44 is configured to, during heating operation, detect the temperature of refrigerant that enters the first heat transfer unit 21 of the intermediate heat exchanger 20. The temperature sensor 45 is, for example, a thermistor. The temperature sensor 45 is configured to, during cooling operation, detect the temperature of refrigerant that enters the first heat transfer unit 21 of the intermediate heat exchanger 20. The temperature sensor 45 is configured to, during heating operation, detect the temperature of refrigerant that exits the first heat transfer unit 21 of the intermediate heat exchanger 20. The pressure sensor 46 detects the pressure of refrigerant that is discharged from the compressor 11. The pressure sensor 47 detects the temperature of refrigerant that is sucked into the compressor 11.

For example, the air-conditioning apparatus 100 includes a temperature sensor 34*a* and a temperature sensor 35*a* that are provided at the indoor unit 3*a*. The temperature sensor 34*a* is, for example, a thermistor, and detects the temperature of the heat medium that enters the use-side heat exchanger 31*a*. The temperature sensor 35*a* is, for example, a thermistor, and detects the temperature of the heat medium that exits the use-side heat exchanger 31*a*. For example, the air-conditioning apparatus 100 includes a temperature sensor 34*b* and a temperature sensor 35*b* that are provided at the indoor unit 3*b*. The temperature sensor 34*b* is, for example, a thermistor, and detects the temperature of the heat medium that enters the use-side heat exchanger 31*b*. The temperature sensor 35*b* is, for example, a thermistor, and detects the temperature of the heat medium that exits the use-side heat exchanger 31*b*.

The controller 50 is configured to, based on information such as values detected by the various sensors provided at the air-conditioning apparatus 100, control the following features: activation and deactivation of the compressor 11; the driving frequency of the compressor 11; the flow path of the flow switching device 12; activation and deactivation of the fan 14; the rotation speed of the fan 14 during driving of the fan 14; the opening degree of the expansion device 15; activation and deactivation of the pump 23; the driving frequency of the pump 23; the opening degree of the flow control valve 32*a*; the opening degree of the flow control valve 32*b*; activation and deactivation of the fan 33*a*; the rotation speed of the fan 33*a* during driving of the fan 33*a*; activation and deactivation of the fan 33*b*; the rotation speed of the fan 33*b* during driving of the fan 33*b*; the opening degree of the supply valve 62; and the opening degree of the discharge valve 67. The controller 50 may be a dedicated piece of hardware, or may be a central processing unit (CPU) that executes a program stored in a memory. The CPU is also referred to as a central processing unit, a processing unit, a computing unit, a microprocessor, a microcomputer, or a processor.

If the controller 50 is a dedicated piece of hardware, the controller 50 corresponds to, for example, a single circuit, a composite circuit, an application specific integrated circuit (ASIC), a field-programmable gate array (FPGA), or a combination thereof. The functional units to be implemented by the controller 50 may be each implemented by an individual piece of hardware, or the functional units may be implemented by a single piece of hardware.

If the controller 50 is a CPU, each function to be executed by the controller 50 is implemented by software, firmware, or a combination of software and firmware. The software and the firmware are each described as a program, and stored in a memory. As the CPU reads and executes the program stored in the memory, each function of the controller 50 is implemented. The memory is, for example, a non-volatile or volatile semiconductor memory, such as a RAM, a ROM, a flash memory, an EPROM, or an EEPROM.

The functions of the controller 50 may be partially implemented by dedicated hardware, and may be partially implemented by software or firmware. Although the controller 50 is accommodated in the heat source unit 1 in Embodiment 1, the controller 50 may be accommodated in the indoor unit 3*a* or the indoor unit 3*b*. The controller 50 may be divided into separate parts that are accommodated in at least two of the heat source unit 1, the indoor unit 3*a*, and the indoor unit 3*b*.

The controller 50 includes the following functional units: an input unit 51, a receiving unit 52, a control unit 53, and an operation-mode switching unit 54.

The input unit 51 is a functional unit configured to receive input of a command from a remote control or other device (not illustrated). For example, the input unit 51 receives, from a remote control or other device (not illustrated), an input of an operation mode that is being required for the air-conditioning apparatus 100, As will be described later, the air-conditioning apparatus 100 according to Embodiment 1 includes a cooling operation mode, a heating operation mode, and an air discharge operation mode. Further, as will be described later, the air discharge operation mode of the air-conditioning apparatus 100 according to Embodiment 1 includes a first operation mode, and a second operation mode performed after the first operation mode.

The receiving unit 52 is a functional unit configured to receive values detected by the various sensors provided at the air-conditioning apparatus 100.

The control unit 53 is a functional unit configured to, based on values detected by the various sensors provided at the air-conditioning apparatus 100 and based on a command or other information input to the input unit 51, control the following features: activation and deactivation of the compressor 11; the driving frequency of the compressor 11; the flow path of the flow switching device 12: activation and deactivation of the fan 14; the rotation speed of the fan 14 during driving of the fan 14; the opening degree of the expansion device 15; activation and deactivation of the pump 23; the driving frequency of the pump 23; the opening degree of the flow control valve 32*a*; the opening degree of the flow control valve 32*b*; activation and deactivation of the fan 33*a*; the rotation speed of the fan 33*a* during driving of the fan 33*a*; activation and deactivation of the fan 33*b*; the rotation speed of the fan 33*b* during driving of the fan 33*b*; the opening degree of the supply valve 62; and the opening degree of the discharge valve 67.

The operation-mode switching unit 54 is a functional unit configured to, during operation of the air-conditioning apparatus 100 in the air discharge operation mode, determine whether to switch from the first operation mode to the second operation mode. That is, the controller 50 according to Embodiment 1 can be said to be a controller that is also capable of switching from the first operation mode to the second operation mode during operation in the air discharge operation mode.

Reference is now made to how the air-conditioning apparatus 100 operates in the cooling operation mode, the heating operation mode and the air discharge operation mode.

[Cooling Operation Mode]

The cooling operation mode is an operation mode in which at least one of the indoor unit 3*a* and the indoor unit 3*b* performs indoor cooling. That is, the cooling operation mode is an operation mode in which the air-conditioning apparatus 100 performs a cooling operation. The following describes a case in which both the indoor unit 3*a* and the indoor unit 3*b* perform indoor cooling.

Reference is first made to the flow of refrigerant in the refrigerant cycle circuit 110. The compressor 11 sucks and compresses low-temperature, low-pressure gas refrigerant, and discharges the resulting refrigerant as high-temperature, high-pressure gas refrigerant. The high-temperature, high-pressure gas refrigerant discharged from the compressor 11 passes through the flow switching device 12 into the heat source-side heat exchanger 13 that functions as a radiator. Upon entering the heat source-side heat exchanger 13, the high-temperature, high-pressure gas refrigerant is cooled by outdoor air supplied from the fan 14, and turns into liquid refrigerant at a medium temperature and high pressure, which then exits the heat source-side heat exchanger 13. In some cases, refrigerant exiting the heat source-side heat exchanger 13 at this time is two-phase gas-liquid refrigerant at a medium temperature and high pressure. The medium-temperature, high-pressure refrigerant exiting the heat source-side heat exchanger 13 flows into the expansion device 15.

The medium-temperature, high-pressure refrigerant entering the expansion device 15 undergoes a pressure reduction in the expansion device 15 and turns into low-temperature, low-pressure two-phase gas-liquid refrigerant, which then exits the expansion device 15. After exiting the expansion device 15, the low-temperature, low-pressure two-phase gas-liquid refrigerant flows into the first heat transfer unit 21 of the intermediate heat exchanger 20 that functions as an evaporator. Upon entering the first heat transfer unit 21 of the intermediate heat exchanger 20, the low-temperature, low-pressure two-phase gas-liquid refrigerant is heated by the heat medium flowing in the second heat transfer unit 22 of the intermediate heat exchanger 20, and turns into low-temperature, low-pressure gas refrigerant, which then exits the first heat transfer unit 21 of the intermediate heat exchanger 20. In some cases, refrigerant exiting the first heat transfer unit 21 of the intermediate heat exchanger 20 at this time is two-phase gas-liquid refrigerant at a low temperature and low pressure. After exiting the first heat transfer unit 21 of the intermediate heat exchanger 20, the low-temperature, low-pressure refrigerant passes through the flow switching device 12 into the accumulator 19. Of the low-temperature low-pressure refrigerant entering the accumulator 19, low-temperature, low-pressure gas refrigerant is sucked into the compressor 11 again.

Reference is now made to the flow of the heat medium in the heat-medium cycle circuit 120. The heat medium discharged from the pump 23 flows into the second heat transfer unit 22 of the intermediate heat exchanger 20. Upon entering the second heat transfer unit 22 of the intermediate heat exchanger 20, the heat medium is cooled by the refrigerant flowing in the first heat transfer unit 21 of the intermediate heat exchanger 20. The resulting heat medium then exits the second heat transfer unit 22 of the intermediate heat exchanger 20. After exiting the second heat transfer unit 22 of the intermediate heat exchanger 20, the heat medium passes through the pipe 121 into the pipe 122. A portion of the heat medium entering the pipe 122 passes through the pipe 123*a* and the flow control valve 32*a* into the use-side heat exchanger 31*a*. The remainder of the refrigerant entering the pipe 122 passes through the pipe 123*b* and the flow control valve 32*b* into the use-side heat exchanger 31*b*.

The heat medium entering the use-side heat exchanger 31*a* is heated as the heat medium cools indoor air supplied from the fan 33*a*, The resulting heat medium then exits the use-side heat exchanger 31*a*. After exiting the use-side heat exchanger 31*a*, the heat medium passes through the pipe 127*a* into the pipe 126. The heat medium entering the use-side heat exchanger 31*b* is heated as the heat medium cools indoor air supplied from, the fan 33*b*. The resulting heat medium then exits the use-side heat exchanger 31*b*. After exiting the use-side heat exchanger 31*b*, the heat medium passes through the pipe 127*b* into the pipe 126, where the heat medium combines with the heat medium entering the pipe 126 from the use-side heat exchanger 31*a*. The heat medium entering the pipe 126 then passes through the pipe 125, and is sucked into the pump 23 again.

In the cooling operation mode, refrigerant at a low temperature enters the first heat transfer unit 21 of the intermediate heat exchanger 20. If refrigerant at a temperature lower than or equal to zero degrees Celsius enters the first heat transfer unit 21 of the intermediate heat exchanger 20 at this time, this may cause the heat medium flowing in the second heat transfer unit 22 of the intermediate heat exchanger 20 to freeze. Accordingly, the control unit 53 of the controller 50 is configured to, based on a temperature detected by the first temperature sensor 24 and a temperature detected by the second temperature sensor 25, perform a control to prevent freezing of the heat medium. Specifically, in response to the first temperature sensor 24 and the second temperature sensor 25 each detecting a temperature indicative of potential freezing of the heat medium, the control unit 53 causes the driving frequency of the compressor 11 to decrease to thereby increase the temperature of refrigerant entering the first heat transfer unit 21 of the intermediate heat exchanger 20.

[Heating Operation Mode]

The heating operation mode is an operation mode in which at least one of the indoor unit 3*a* and the indoor unit 3*b* performs indoor heating. That is, the heating operation mode is an operation mode in which the air-conditioning apparatus 100 performs a heating operation. The following describes a case in which both the indoor unit 3*a* and the indoor unit 3*b* perform indoor heating.

Reference is first made to the flow of refrigerant in the refrigerant cycle circuit 110. The compressor 11 sucks and compresses low-temperature, low-pressure gas refrigerant, and discharges the resulting refrigerant as high-temperature, high-pressure gas refrigerant. The high-temperature, high-pressure gas refrigerant discharged from the compressor 11 passes through the flow switching device 12 into the first heat transfer unit 21 of the intermediate heat exchanger 20 that functions as a radiator. Upon entering the first heat transfer unit 21 of the intermediate heat exchanger 20, the high-temperature, high-pressure gas refrigerant is cooled by the heat medium flowing in the second heat transfer unit 22 of the intermediate heat exchanger 20, and turns into medium-temperature, high-pressure liquid refrigerant, which then exits the first heat transfer unit 21 of the intermediate heat exchanger 20. The medium-temperature, high-pressure refrigerant exiting the first heat transfer unit 21 of the intermediate heat exchanger 20 flows into the expansion device 15.

The medium-temperature, high-pressure refrigerant entering the expansion device 15 undergoes a pressure reduction in the expansion device 15 and turns into low-temperature, low-pressure two-phase gas-liquid refrigerant, which then exits the expansion device 15. After exiting the expansion device 15, the low-temperature, low-pressure two-phase gas-liquid refrigerant flows into the heat source-side heat exchanger 13 that functions as an evaporator. Upon entering the heat source-side heat exchanger 13, the low-temperature, low-pressure two-phase gas-liquid refrigerant is heated by outdoor air supplied from the fan 14 and turns into gas refrigerant at a low temperature and low pressure, which then exits the heat source-side heat exchanger 13. In some cases, refrigerant exiting the heat source-side heat exchanger 13 at this time is two-phase gas-liquid refrigerant at a low temperature and low pressure. After exiting the heat source-side heat exchanger 13, the low-temperature, low-pressure refrigerant passes through the flow switching device 12 into the accumulator 19. Of the low-temperature, low-pressure refrigerant entering the accumulator 19, low-temperature, low-pressure gas refrigerant is sucked into the compressor 11 again.

Reference is now made to the flow of the heat medium in the heat-medium cycle circuit 120. The heat medium discharged from the pump 23 flows into the second heat transfer unit 22 of the intermediate heat exchanger 20. Upon entering the second heat transfer unit 22 of the intermediate heat exchanger 20, the heat medium is heated by the refrigerant flowing in the first heat transfer unit 21 of the intermediate heat exchanger 20. The resulting heat medium then exits the second heat transfer unit 22 of the intermediate heat exchanger 20. After exiting the second heat transfer unit 22 of the intermediate heat exchanger 20, the heat medium passes through the pipe 121 into the pipe 122. A portion of the heat medium entering the pipe 122 passes through the pipe 123*a* and the flow control valve 32*a* into the use-side heat exchanger 31*a*. The remainder of the refrigerant entering the pipe 122 passes through the pipe 123*b* and the flow control valve 32*b* into the use-side heat exchanger 31*b*.

The heat medium entering the use-side heat exchanger 31*a* is cooled as the heat medium heats indoor air supplied from the fan 33*a*. The resulting heat medium then exits the use-side heat exchanger 31*a*. After exiting the use-side heat exchanger 31*a*, the heat medium passes through the pipe 127*a* into the pipe 126. The heat medium entering the use-side heat exchanger 31*b* is cooled as the heat medium heats indoor air supplied from the fan 33*b*. The resulting heat medium then exits the use-side heat exchanger 31*b*. After exiting the use-side heat exchanger 31*b*, the heat medium passes through the pipe 127*b* into the pipe 126, where the heat medium combines with the heat medium entering the pipe 126 from the use-side heat exchanger 31*a*. The heat medium entering the pipe 126 then passes through the pipe 125, and is sucked into the pump 23 again.

[Air Discharge Operation Mode]

Figure 2:
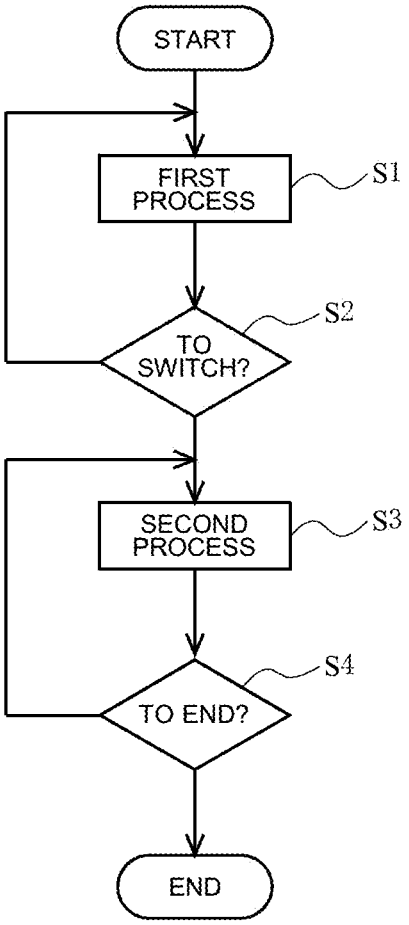
FIG. 2 is a flowchart illustrating an air discharge operation mode of the air-conditioning apparatus according to Embodiment 1.

The air discharge operation mode is an operation mode in which air present inside the heat-medium cycle circuit 120 is discharged to the outside of the heat-medium cycle circuit 120. As described above, the air discharge operation mode of the air-conditioning apparatus 100 includes a first operation mode, and a second operation mode performed after the first operation mode. The first operation mode is an operation mode in which a first process described later is performed. The second operation mode is an operation mode in which a second process described later is performed. Reference is now made to FIG. 2 to describe a specific procedure for the air discharge operation mode.

FIG. 2 is a flowchart illustrating the air discharging operation mode of the air-conditioning apparatus according to Embodiment 1. That is, FIG. 2 is a flowchart illustrating how the air-conditioning apparatus 100 according to Embodiment 1 operates in the air discharge operation mode.

In response to the input unit 51 of the controller 50 receiving input of a command for performing the air discharge operation mode, the controller 50 of the air-conditioning apparatus 100 performs a first process at step S1. In other words, the controller 50 sets the operation mode of the air-conditioning apparatus 100 to the first operation mode.

The first process is a process of, with the heat source-side heat exchanger 13 functioning as a radiator, and with the first heat transfer unit 21 of the intermediate heat exchanger 20 functioning as an evaporator, circulating refrigerant in the refrigerant cycle circuit 110. Further, the first process is a process of, with the discharge valve of the discharge mechanism 65 being closed, circulating the heat medium in the heat-medium cycle circuit 120. In other words, the first operation mode is an operation mode in which, with the heat source-side heat exchanger 13 functioning as a radiator, and with the first heat transfer unit 21 of the intermediate heat exchanger 20 functioning as an evaporator, refrigerant circulates in the refrigerant cycle circuit 110. Further, the first operation mode is an operation mode in which, with the discharge valve 67 of the discharge mechanism 65 being closed, the heat medium circulates in the heat-medium cycle circuit 120.

That is, the operation of the air-conditioning apparatus 100 in the first operation mode is basically similar to the operation of the air-conditioning apparatus 100 in the cooling operation mode, Specifically, the control unit 53 of the controller 50 switches the flow path of the flow switching device 12 to the same flow path as that during cooling operation. Further, the control unit 53 opens the flow control valve 32*a* and the flow control valve 32*b*. In this state, the control unit 53 activates the compressor 11, the fan 14, and the pump 23. Further, the control unit 53 controls the opening degree of the expansion device 15 such that refrigerant exiting the heat source-side heat exchanger 13 undergoes a decrease in pressure and expands.

As a result, the heat medium flowing in the second heat transfer unit 22 of the intermediate heat exchanger 20 is cooled by the refrigerant flowing in the first heat transfer unit 21 of the intermediate heat exchanger 20. The cooled heat medium then circulates in the heat-medium cycle circuit 120, In this regard, the lower the temperature of the heat medium, the greater the rate at which air dissolves into the heat medium. Accordingly, by circulating the cooled heat medium in the heat-medium cycle circuit 120 as described above, an air parcel present inside the heat-medium cycle circuit 120 can be dissolved into the heat medium.

If the fan 33*a* and the fan 33*b* are running during operation in the first operation mode, the heat medium circulating in the heat-medium cycle circuit 120 is heated by indoor air supplied by each of the fan 33*a* and the fan 33*b*. This causes the temperature of the heat medium to increase. The increase in the temperature of the heat medium results in a decrease in the rate at which an air parcel present inside the heat-medium cycle circuit 120 is dissolved into the heat medium. For this reason, in the first operation mode of the air-conditioning apparatus 100 according to Embodiment 1, the control unit 53 deactivates the fan 33*a* and the fan 33*b*. This helps to increase the rate at which an air parcel present inside the heat-medium cycle circuit 120 is dissolved into the heat medium. As a result, the air parcel inside the heat-medium cycle circuit 120 can be efficiently dissolved into the heat medium.

In the first operation mode, the supply valve 62 of the supply mechanism 60 may be set at any opening degree. In one example, if the first process is to be performed when charging of the heat medium into the heat-medium cycle circuit 120 is not yet complete, the first process may be performed with the supply valve 62 of the supply mechanism 60 being open. In another example, if the first process is to be performed when charging of the heat medium into the heat-medium cycle circuit 120 is complete, the first process may be performed with the supply valve 62 of the supply mechanism 60 being closed.

After step S1, the controller 50 proceeds to step S2. Step S2 is a step of determining whether to switch from the first process to the second process. That is, at step S2, the operation-mode switching unit 54 of the controller 50 determines whether to switch from the first operation mode to the second operation mode. The operation-mode switching unit 54 returns to step S1 until an air parcel present inside the heat-medium cycle circuit 120 is assumed to have completely dissolved into the heat medium. Thus, the first process is continued. In other words, the first operation mode is maintained. Once an air parcel present inside the heat-medium cycle circuit 120 is assumed to have completely dissolved into the heat medium, the operation-mode switching unit 54 proceeds to step S3. That is, the operation-mode switching unit 4 determines to switch from the first operation mode to the second operation mode. According to Embodiment 1, whether to switch from the first operation mode to the second operation mode is determined as described below.

Figure 3:
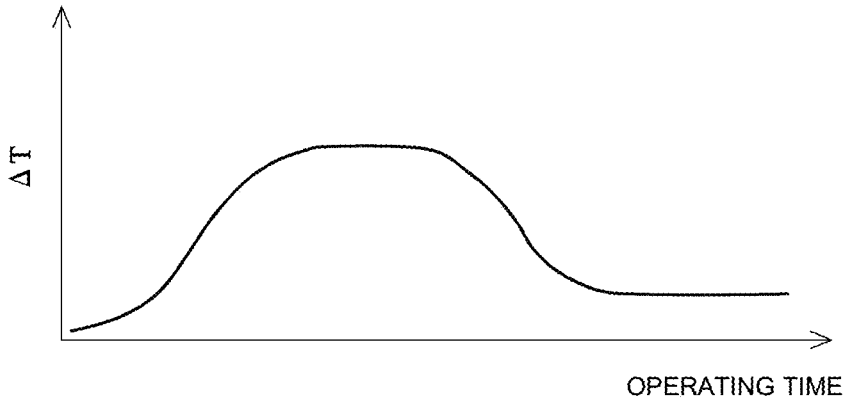
FIG. 3 illustrates how an operation-mode switching unit of a controller included in the air-conditioning apparatus according to Embodiment 1 determines whether to switch operation modes.

FIG. 3 illustrates how the operation-mode switching unit of the controller included in the air-conditioning apparatus according to Embodiment 1 determines whether to switch operation modes. In FIG. 3, the horizontal axis represents the time for which the air-conditioning apparatus 100 is operated in the first operation mode. In FIG. 3, ΔT taken along the vertical axis represents a temperature difference obtained by subtracting a temperature detected by the second temperature sensor 25 from a temperature detected by the first temperature sensor 24. That is, ΔT represents a temperature difference obtained by subtracting the temperature of the heat medium exiting the second heat transfer unit 22 of the intermediate heat exchanger 20 from the temperature of the heat medium entering the second heat transfer unit 22 of the intermediate heat exchanger 20.

Immediately after the start of the first operation mode, the heat medium has not yet been cooled in the second heat transfer unit 22 of the intermediate heat exchanger 20, and thus ΔT is close to zero degrees Celsius. As the air-conditioning apparatus 100 continues to be operated in the first operation mode, the heat medium is cooled progressively in the second heat transfer unit 22 of the intermediate heat exchanger 20. As a result, the temperature of the heat medium exiting the second heat transfer unit 22 of the intermediate heat exchanger 20 decreases progressively, and thus the value of ΔT increases progressively. As described above, in the first operation mode, the fan 33*a* and the fan 33*b* are deactivated to ensure that the heat medium is not heated by indoor air supplied from each of the fan 33*a* and the fan 33*b*. Consequently, as the air-conditioning apparatus 100 continues to be operated in the first operation mode, the temperature of the heat medium entering the second heat transfer unit 22 of the intermediate heat exchanger 20 decreases progressively. Meanwhile, as the temperature of the heat medium flowing in the second heat transfer unit 22 of the intermediate heat exchanger 20 approaches the temperature of the refrigerant flowing in the first heat transfer unit 21 of the intermediate heat exchanger 20, the decrease per unit time of the temperature of the heat medium exiting the second heat transfer unit 22 of the intermediate heat exchanger 20 decreases.

Accordingly, as the air-conditioning apparatus 100 continues to be operated in the first operation mode, ΔT increases first and then decreases progressively, and the change of ΔT per unit time eventually becomes less than or equal to a predetermined value. In other words, as the air-conditioning apparatus 100 continues to be operated in the first operation mode, ΔT decreases progressively, and ΔT eventually becomes substantially constant. This is indicative of a state in which a sufficiently cooled heat medium is circulating in the heat-medium cycle circuit 120, that is, a state in which the temperature of the heat medium inside the heat-medium cycle circuit 120 has become substantially uniform. Therefore, this is indicative of a state in which an air parcel present inside the heat-medium cycle circuit 120 is assumed to have completely dissolved into the heat medium. Accordingly, the operation-mode switching unit 54 determines to switch from the first operation mode to the second operation mode, after ΔT decreases and the change of ΔT per unit time becomes less than or equal to a predetermined value. In other words, the controller 50 switches from the first operation mode to the second operation mode after ΔT decreases and the change of ΔT per unit time becomes less than or equal to a predetermined value.

At step S3 subsequent to step S2, the second process is performed. In other words, the controller 50 changes the operation mode of the air-conditioning apparatus 100 to the second operation mode. The second process is a process of, with the heat source-side heat exchanger 13 functioning as an evaporator, and with the first heat transfer unit 21 of the intermediate heat exchanger 20 functioning as a radiator, circulating refrigerant in the refrigerant cycle circuit 110. Further, the second process is a process of, with the discharge valve 67 of the discharge mechanism 65 being open, circulating the heat medium in the heat-medium cycle circuit 120. In other words, the second operation mode is an operation mode in which, with the heat source-side heat exchanger 13 functioning as an evaporator, and with the first heat transfer unit 21 of the intermediate heat exchanger 20 functioning as a radiator, refrigerant circulates in the refrigerant cycle circuit 110. Further, the second operation mode is an operation mode in which, with the discharge valve 67 of the discharge mechanism 65 being open, the heat medium circulates in the heat-medium cycle circuit 120.

That is, the operation of the air-conditioning apparatus 100 in the second operation mode is basically similar to the operation of the air-conditioning apparatus 100 in the heating operation mode, except that the discharge valve 67 of the discharge mechanism 65 is open. Specifically, the control unit 53 of the controller 50 switches the flow path of the flow switching device 12 to the same flow path as that during heating operation. Further, the control unit 53 opens the flow control valve 32*a* and the flow control valve 32*b*. In this state, the control unit 53 activates the compressor 11, the fan 14, and the pump 23. Further, the control unit 53 controls the opening degree of the expansion device 15 such that refrigerant exiting the first heat transfer unit 21 of the intermediate heat exchanger 20 undergoes a decrease in pressure and expands.

As a result, the heat medium flowing in the second heat transfer unit 22 of the intermediate heat exchanger 20 is heated by the refrigerant flowing in the first heat transfer unit 21 of the intermediate heat exchanger 20. The heated heat medium then circulates in the heat-medium cycle circuit 120. In this regard, the higher the temperature of the heat medium, the lower the rate at which air dissolves into the heat medium. Accordingly, by circulating the heated heat medium in the heat-medium cycle circuit 120 as described above, air that has been dissolved in the heat medium can be released from the heat medium and the air released from the heat medium can be discharged through the discharge mechanism 65 to the outside of the heat-medium cycle circuit 120. Consequently, in the air discharge operation mode according to Embodiment 1, an air parcel present inside the heat-medium cycle circuit 120, and air that has been dissolved in the heat medium since the charging of the heat medium into the heat-medium cycle circuit 120 can be both discharged to the outside of the heat-medium cycle circuit 120. Therefore, the air discharge operation mode according to Embodiment 1 allows for greater discharge of air present inside the heat-medium cycle circuit 120 to the outside of the heat-medium cycle circuit 120 than is conventionally possible.

If the fan 33*a* and the fan 33*b* are running during operation in the second operation mode, the heat medium circulating in the heat-medium cycle circuit 120 is cooled by indoor air supplied by each of the fan 33*a* and the fan 33*b*. This causes the temperature of the heat medium to decrease. The decrease in the temperature of the heat medium results in a decrease in the rate at which air dissolved in the heat medium is released from the heat medium. For this reason, in the second operation mode of the air-conditioning apparatus 100 according to Embodiment 1, the control unit 53 deactivates the fan 33*a* and the fan 33*b*. This helps to increase the rate at which air dissolved in the heat medium is released from the heat medium, leading to reduced operating time in the second operation mode.

In the second operation mode, the supply valve 62 of the supply mechanism 60 may be at any opening degree. In one example, if the discharge mechanism 65 is configured to be capable of discharging only air, the second process may be performed with the supply valve 62 of the supply mechanism 60 being closed. In another example, if the discharge mechanism 65 is configured to discharge the heat medium together with air, the second process may be performed with the supply valve 62 of the supply mechanism 60 being open and with the heat medium being charged into the heat-medium cycle circuit 120.

After step S3, the controller 50 proceeds to step 84, Step 84 is a step of determining whether to end the second process. According to Embodiment 1, until a predetermined time elapses after the start of the second process, the controller 50 determines not to end the second process, and returns to step S3. Upon elapse of the predetermined time after the start of the second process, the controller 50 determines to end the second process. As a result, the operation of the air-conditioning apparatus 100 in the air discharge operation mode ends.

In the air-conditioning apparatus 100 according to Embodiment 1, the controller 50 automatically performs all of the following operations: the first process; the determination of whether to switch from the first process to the second process; the switching from the first process to the second process; the second process; and the determination of whether to end the second process. However, this is not intended to be limiting. Alternatively, at least one of these operations may be performed manually by the operator.

As described above, the air-conditioning apparatus 100 according to Embodiment 1 includes the intermediate heat exchanger 20, the refrigerant cycle circuit 110, the heat-medium cycle circuit 120 and the discharge mechanism 65. The intermediate heat exchanger 20 includes the first heat transfer unit 21 in which refrigerant flows, and the second heat transfer unit 22 in which a heat medium different from the refrigerant flows. The intermediate heat exchanger 20 is configured to exchange heat between the first heat transfer unit 21 and the second heat transfer unit 22. The refrigerant cycle circuit 110 includes the heat source-side heat exchanger 13. The heat source-side heat exchanger 13 is connected with the first heat transfer unit 21 by a pipe. The refrigerant cycle circuit 110 is configured to allow the refrigerant to circulate inside the refrigerant cycle circuit 110. The heat-medium cycle circuit 120 includes a use-side heat exchange. The use-side heat exchanger is connected with the second heat transfer unit 22 by a pipe. The heat-medium cycle circuit 120 is configured to allow the heat medium to circulate inside the heat-medium cycle circuit 120. The discharge mechanism 65 is provided at the heat-medium cycle circuit 120, and includes the discharge valve 67. The discharge mechanism 65 is configured to, when the discharge valve 67 is open, discharge air present inside the heat-medium cycle circuit 120 to the outside of the heat-medium cycle circuit 120. The air-conditioning apparatus 100 is configured to execute the air discharge operation mode in which the air present inside the heat-medium cycle circuit 120 is discharged to the outside of the heat-medium cycle circuit 120. The air discharge operation mode includes the first operation mode, and the second operation mode performed after the first operation mode. The first operation mode is an operation mode in which, with the heat source-side heat exchanger 13 functioning as a radiator, and with the first heat transfer unit 21 of the intermediate heat exchanger 20 functioning as an evaporator, the refrigerant circulates in the refrigerant cycle circuit 110. Further, the first operation mode is an operation mode in which, with the discharge valve 67 of the discharge mechanism 65 being closed, the heat medium circulates in the heat-medium cycle circuit 120. The second operation mode is an operation mode in which, with the heat source-side heat exchanger 13 functioning as an evaporator, and with the first heat transfer unit 21 of the intermediate heat exchanger 20 functioning as a radiator, the refrigerant circulates in the refrigerant cycle circuit 110. Further, the second operation mode is an operation mode in which, with the discharge valve 67 of the discharge mechanism 65 being open, the heat medium circulates in the heat-medium cycle circuit 120.

As described above, with the air-conditioning apparatus 100 configured as mentioned above, an air parcel present inside the heat-medium cycle circuit 120, and air that has been dissolved in the heat medium since the charging of the heat medium into the heat-medium cycle circuit 120 can be both discharged to the outside of the heat-medium cycle circuit 120. Therefore, the air-conditioning apparatus 100 configured as described above allows for greater discharge of air present inside the heat-medium cycle circuit 120 to the outside of the heat-medium cycle circuit 120 than is conventionally possible.

An air discharge method for the air-conditioning apparatus 100 according to Embodiment 1 is an air discharge method for the air-conditioning apparatus 100 that includes the intermediate heat exchanger 20, the refrigerant cycle circuit 110, the heat-medium cycle circuit 120, and the discharge mechanism 65. The intermediate heat exchanger 20 includes the first heat transfer unit 21 in which refrigerant flows, and the second heat transfer unit 22 in which a heat medium different from the refrigerant flows. The intermediate heat exchanger 20 is configured to exchange heat between the first heat transfer unit 21 and the second heat transfer unit 22, The refrigerant cycle circuit 110 includes the heat source-side heat exchanger 13. The heat source-side heat exchanger 13 is connected with the first heat transfer unit 21 by a pipe. The refrigerant cycle circuit 110 is configured to allow the refrigerant to circulate inside the refrigerant cycle circuit 110. The heat-medium cycle circuit 120 includes a use-side heat exchanger. The use-side heat exchanger is connected with the second heat transfer unit 22 by a pipe. The heat-medium cycle circuit 120 is configured to allow the heat medium to circulate inside the heat-medium cycle circuit 120. The discharge mechanism 65 is provided at the heat-medium cycle circuit 120, and includes the discharge valve 67. The discharge mechanism 65 is configured to, when the discharge valve 67 is open, discharge air present inside the heat-medium cycle circuit 120 to the outside of the heat-medium cycle circuit 120. The air discharge method for the air-conditioning apparatus 100 according to Embodiment 1 is a method for discharging the air present inside the heat-medium cycle circuit 120 to the outside of the heat-medium cycle circuit 120. The air discharge method includes a first process, and a second process performed after the first process. The first process is a process of, with the heat source-side heat exchanger 13 functioning as a radiator, and with the first heat transfer unit 21 of the intermediate heat exchanger 20 functioning as an evaporator, circulating refrigerant in the refrigerant cycle circuit 110. Further, the first process is a process of, with the discharge valve of the discharge mechanism 65 being closed, circulating the heat medium in the heat-medium cycle circuit 120. The second process is a process of, with the heat source-side heat exchanger 13 functioning as an evaporator, and with the first heat transfer unit 21 of the intermediate heat exchanger 20 functioning as a radiator, circulating the refrigerant in the refrigerant cycle circuit 110. Further, the second process is a process of, with the discharge valve 67 of the discharge mechanism 65 being open, circulating the heat medium in the heat-medium cycle circuit 120.

As described above, with the air discharge method for the air-conditioning apparatus 100 according to Embodiment 1, an air parcel present inside the heat-medium cycle circuit 120, and air that has been dissolved in the heat medium since the charging of the heat medium into the heat-medium cycle circuit 120 can be both discharged to the outside of the heat-medium cycle circuit 120, Therefore, the air discharge method for the air-conditioning apparatus 100 according to Embodiment 1 allows for greater discharge of air present inside the heat-medium cycle circuit 120 to the outside of the heat-medium cycle circuit 120 than is conventionally possible.

Embodiment 2

As described above, in the air-conditioning apparatus 100 according to Embodiment 1, a plurality of sets of a use-side heat exchanger and a flow control valve, which is a valve configured to control the flow rate of the heat medium entering the use-side heat exchanger, are connected in parallel with each other in the heat-medium cycle circuit 120. In the case of the air-conditioning apparatus 100 configured as described above, the air-conditioning apparatus 100 may be operated as described below in the air discharge operation mode. That is, in the case of the air-conditioning apparatus 100 configured as described above, operation in the air discharge operation mode may be performed as described below. In the following description of Embodiment 2, items not particularly mentioned below are assumed to be substantially similar to those according to Embodiment 1, and functions and features identical to those according to Embodiment 1 are denoted by the same reference signs as those used in Embodiment 1.

Figure 4:
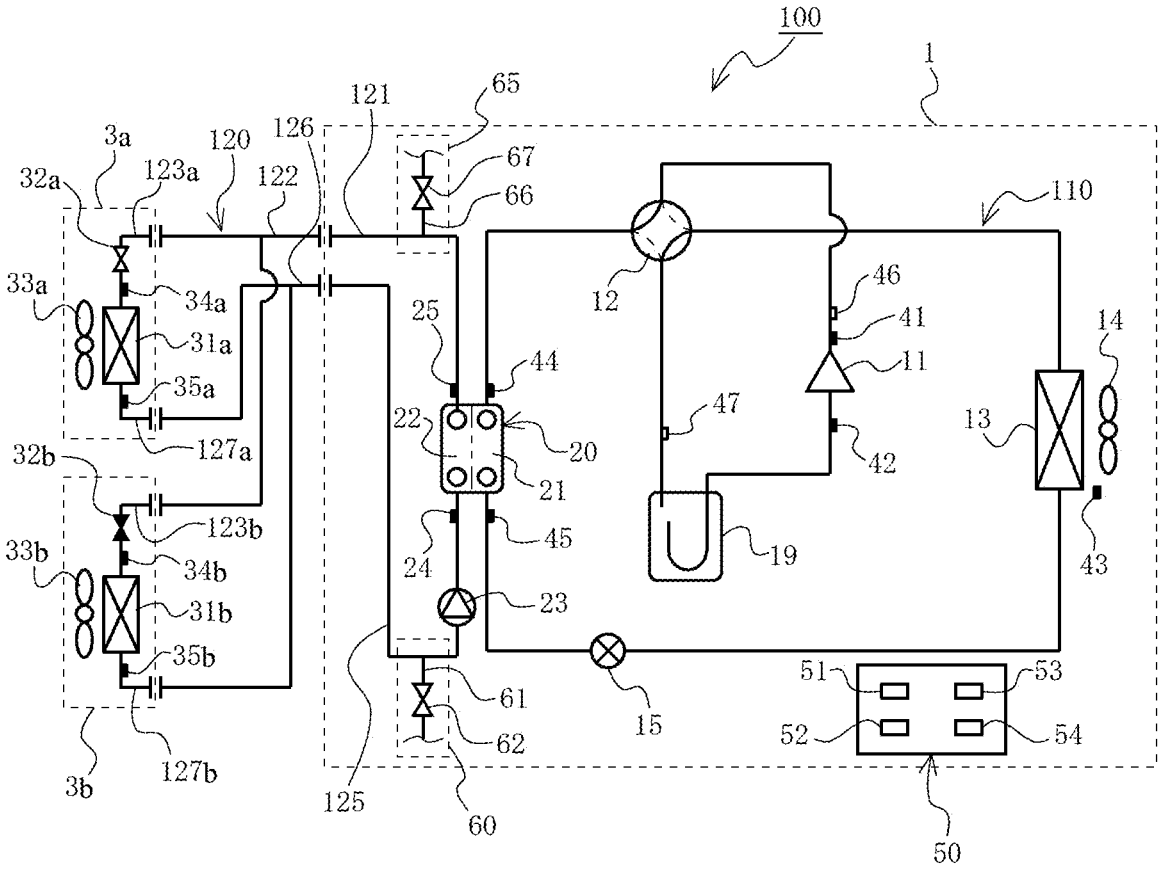
FIG. 4 schematically illustrates an exemplary circuit configuration of an air-conditioning apparatus according to Embodiment 2.
Figure 5:
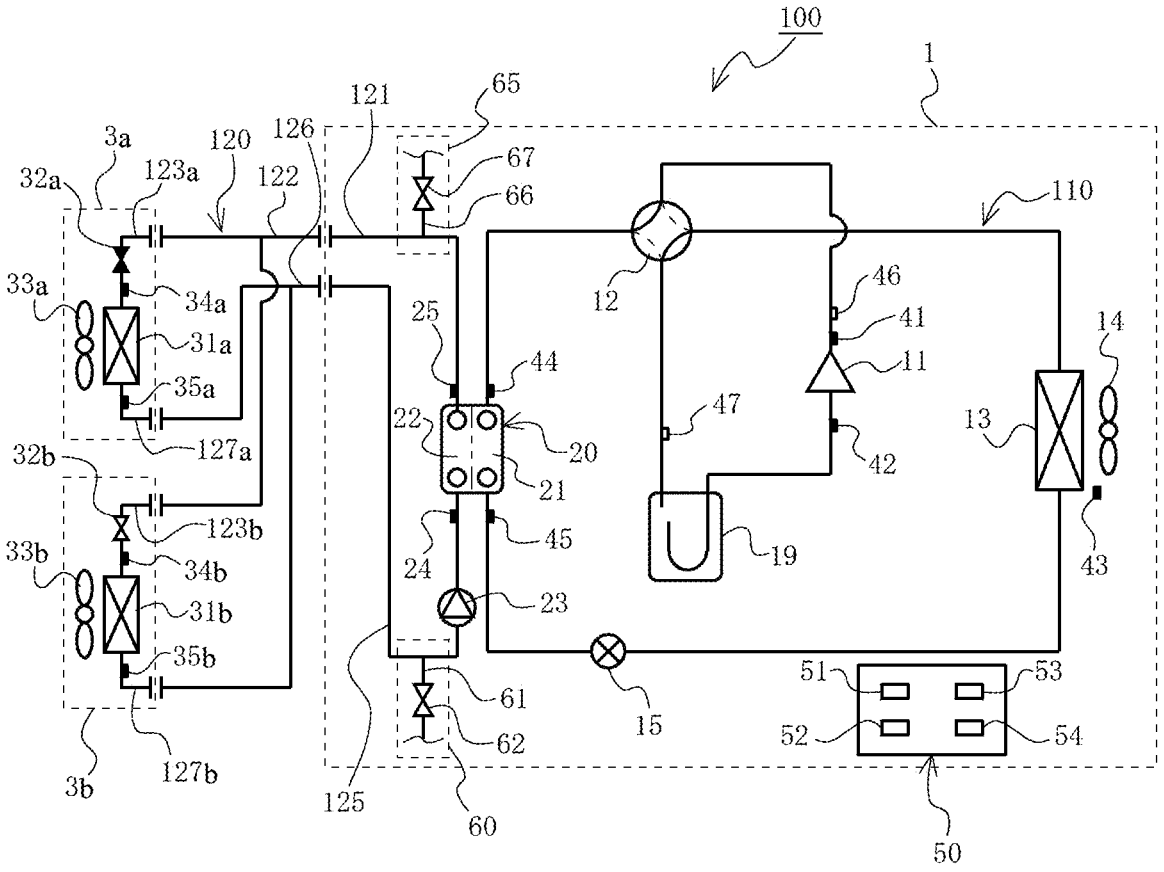
FIG. 5 schematically illustrates an exemplary circuit configuration of the air-conditioning apparatus according to Embodiment 2.

FIGS. 4 and 5 each schematically illustrate an exemplary circuit configuration of an air-conditioning apparatus according to Embodiment 2. In FIGS. 4 and 5, the flow control valve 32*a* and the flow control valve 32*b* are shown in hollow outlines to represent their open state, and shown filled in black to represent their closed state.

In the air-conditioning apparatus 100 according to Embodiment 2, a plurality of sets of a use-side heat exchanger and a flow control valve, which is a valve configured to control the flow rate of the heat medium entering the use-side heat exchanger, are connected in parallel with each other in the heat-medium cycle circuit 120. The air-conditioning apparatus 100 according to Embodiment 2 is configured to, with only one of a plurality of flow control valves being open, perform an operation in the air discharge operation mode described above with reference to Embodiment 1. Further, the air-conditioning apparatus 100 is configured to, after the operation in the air discharge operation mode ends, open only one of the flow control valves that has not been open during the operation in the air discharge operation mode, and then perform an operation in the air discharge operation mode described above with reference to Embodiment 1. As described above, the air-conditioning apparatus 100 according to Embodiment 2 is configured to, with only one of a plurality of flow control valves being open, perform an operation in the air discharge operation mode according to Embodiment 1 for each of the sets.

For example, in the air-conditioning apparatus 100 illustrated in FIGS. 4 and 5, a set of the use-side heat exchanger 31*a* and the flow control valve 32*a*, and a set of the use-side heat exchanger 31*b* and the flow control valve 32*b* are connected in parallel with each other in the heat-medium cycle circuit 120. If the air-conditioning apparatus 100 is adjusted as described above, as illustrated in FIG. 4, an operation in the air discharge operation mode according to Embodiment 1 is performed with the flow control valve 32*a* being open, and with the flow control valve 32*b* being closed. Then, as illustrated in FIG. 5, an operation in the air discharge operation mode according to Embodiment 1 is performed with the flow control valve 32*a* being closed, and with the flow control valve 32*b* being open.

If a plurality of sets of a use-side heat exchanger and a flow control valve are connected in parallel with each other in the heat-medium cycle circuit 120, such an arrangement may in some cases result in a decreased rate at which the heat medium circulates in the heat-medium cycle circuit 120, which may in turn result in a decreased rate at which an air parcel present inside the heat-medium cycle circuit 120 is dissolved into the heat medium. In such cases, it is preferred to perform an operation in the air discharge operation mode as described above with reference to Embodiment 2 to thereby increase the rate at which the heat medium circulates in the heat-medium cycle circuit 120. Performing an operation in the air discharge operation mode as described above with reference to Embodiment 2 helps to increase the rate at which an air parcel present inside the heat-medium cycle circuit 120 is dissolved into the heat medium. This leads to reduced operating time in the air discharge operation mode.

Embodiment 3

The determination at step S2 in FIG. 2 of whether to switch from the first process to the second process may be performed, for example, as in Embodiment 3 described below. In the following description of Embodiment 3, items not particularly mentioned below are assumed to be substantially similar to those according to Embodiment 1 or Embodiment 2, and functions and features identical to those according to Embodiment 1 or Embodiment 2 are denoted by the same reference signs as those used in Embodiment 1 or Embodiment 2.

Figure 6:
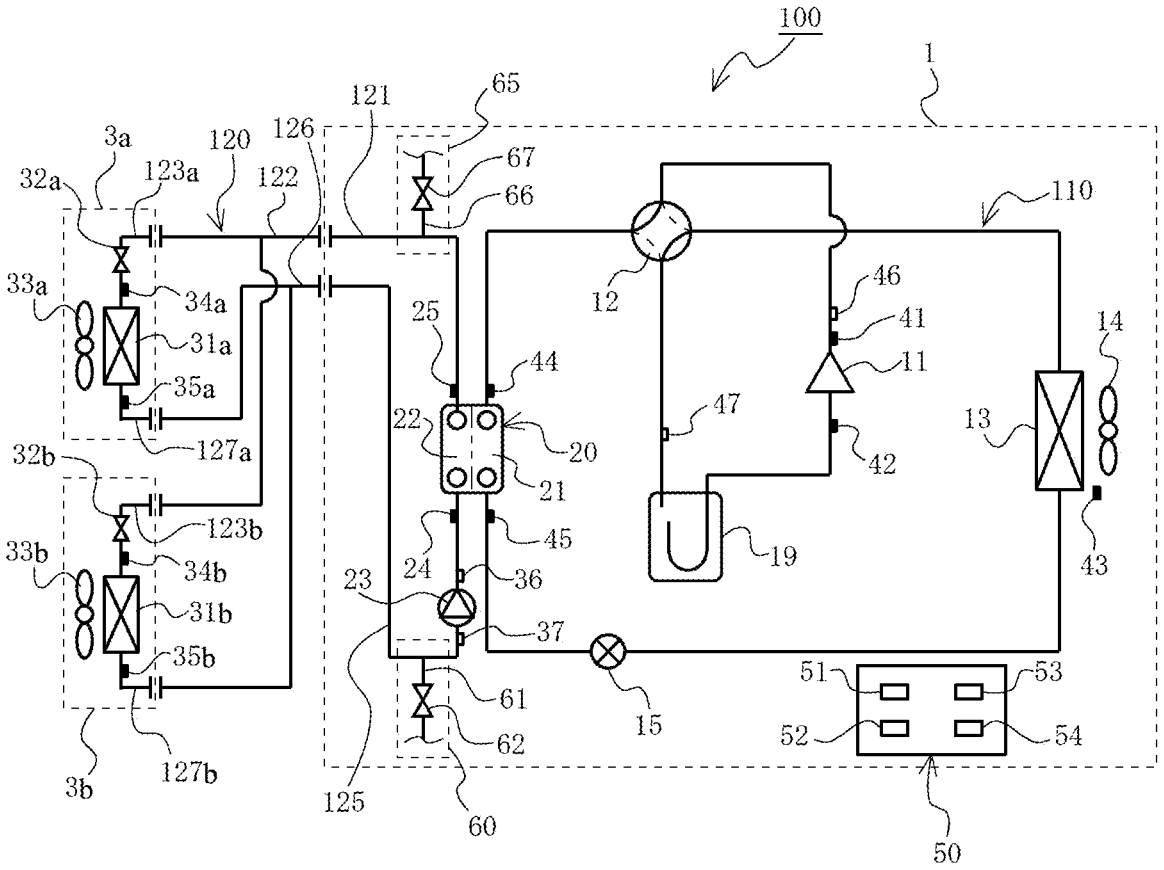
FIG. 6 schematically illustrates an exemplary circuit configuration of an air-conditioning apparatus according to Embodiment 3.

FIG. 6 schematically illustrates an exemplary circuit configuration of an air-conditioning apparatus according to Embodiment 3.

The air-conditioning apparatus 100 according to Embodiment 3 includes a first pressure sensor 36, and a second pressure sensor 37. The first pressure sensor 36 detects the pressure of the heat medium discharged from the pump 23. According to Embodiment 3, the first pressure sensor 36 is provided at the pipe 125 at a location near the discharge side of the pump 23. The second pressure sensor 37 detects the pressure of the heat medium flowing into the pump 23. According to Embodiment 3, the second pressure sensor 37 is provided at the pipe 125 at a location near the suction side of the pump 23. In the air-conditioning apparatus 100 according to Embodiment 3, at step S2 in FIG. 2, the operation-mode switching unit 54 of the controller 50 determines whether to switch from the first operation mode to the second operation mode as described below. A pressure detected by the first pressure sensor 36, and a pressure detected by the second pressure sensor 37 are received by the receiving unit 52 of the controller 50.

Figure 7:
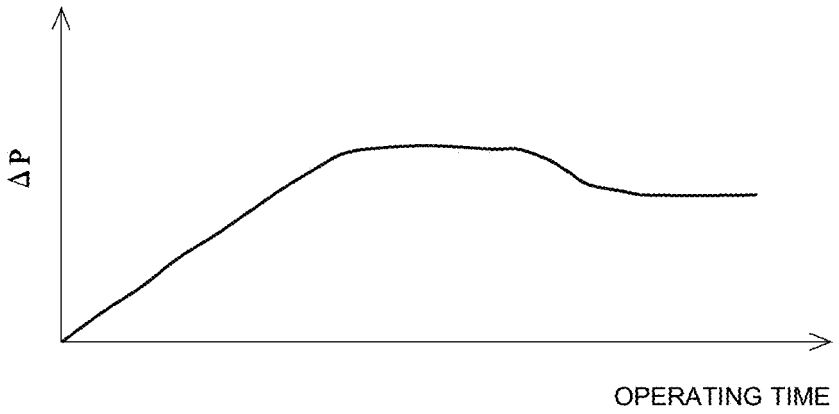
FIG. 7 illustrates how an operation-mode switching unit of a controller included in the air-conditioning apparatus according to Embodiment 3 determines whether to switch operation modes.

FIG. 7 illustrates how the operation-mode switching unit of the controller included in the air-conditioning apparatus according to Embodiment 3 determines whether to switch operation modes. In FIG. 7, the horizontal axis represents the time for which the air-conditioning apparatus 100 is operated in the first operation mode. In FIG. 7, ΔP taken along the vertical axis represents a pressure difference obtained by subtracting a pressure detected by the second pressure sensor 37 from a pressure detected by the first pressure sensor 36, That is, ΔP represents a pressure difference obtained by subtracting the pressure of the heat medium entering the pump 23 from the pressure of the heat medium discharged from the pump 23.

As the air-conditioning apparatus 100 is started to operate in the first operation mode, and the pump 23 is activated, the pressure of the heat medium discharged from the pump 23 increases progressively. This causes ΔP to increase progressively. In this regard, the greater the amount of the air parcel present inside the heat-medium cycle circuit 120, the smaller the effective cross-sectional area of the flow path inside the heat-medium cycle circuit 120, and consequently the greater the rate at which the heat medium circulates in the heat-medium cycle circuit 120. Consequently, the greater the amount of the air parcel present inside the heat-medium cycle circuit 120, the greater the pressure loss in the heat-medium cycle circuit 120, and the greater the value of ΔP. Therefore, as the air-conditioning apparatus 100 continues to be operated in the first operation mode, and the air parcel inside the heat-medium cycle circuit 120 dissolves into the heat medium, ΔP decreases progressively. Then, when the operation of the air-conditioning apparatus 100 in the first operation mode is further continued to the point where the air parcel inside the heat-medium cycle circuit 120 becomes dissolved in the heat medium, the change of ΔP per unit time becomes less than or equal to a predetermined value. In other words, when the operation of the air-conditioning apparatus 100 in the first operation mode is further continued to the point where the air parcel inside the heat-medium cycle circuit 120 becomes dissolved in the heat medium, ΔP becomes substantially constant.

Accordingly, the operation-mode switching unit 54 determines to switch from the first operation mode to the second operation mode, after ΔP decreases and the change of ΔP per unit time becomes less than or equal to a predetermined value. In other words, the controller 50 switches from the first operation mode to the second operation mode after ΔP decreases and the change of ΔP per unit time becomes less than or equal to a predetermined value.

Switching from the first operation mode to the second operation mode as described above also makes it possible to achieve an effect similar to that according to each of Embodiments 1 and 2. Alternatively, the operator may observe ΔP, and the operator may determine whether to switch from the first operation mode to the second operation mode.

Embodiment 4

The determination at step S2 in FIG. 2 of whether to switch from the first process to the second process may be performed, for example, as in Embodiment 4 described below. In the following description of Embodiment 4, items not particularly mentioned below are assumed to be substantially similar to those according to one of Embodiments 1 to 3, and functions and features identical to those according to one of Embodiments 1 to 3 are denoted by the same reference signs as those used in the one of Embodiments 1 to 3.

Figure 8:
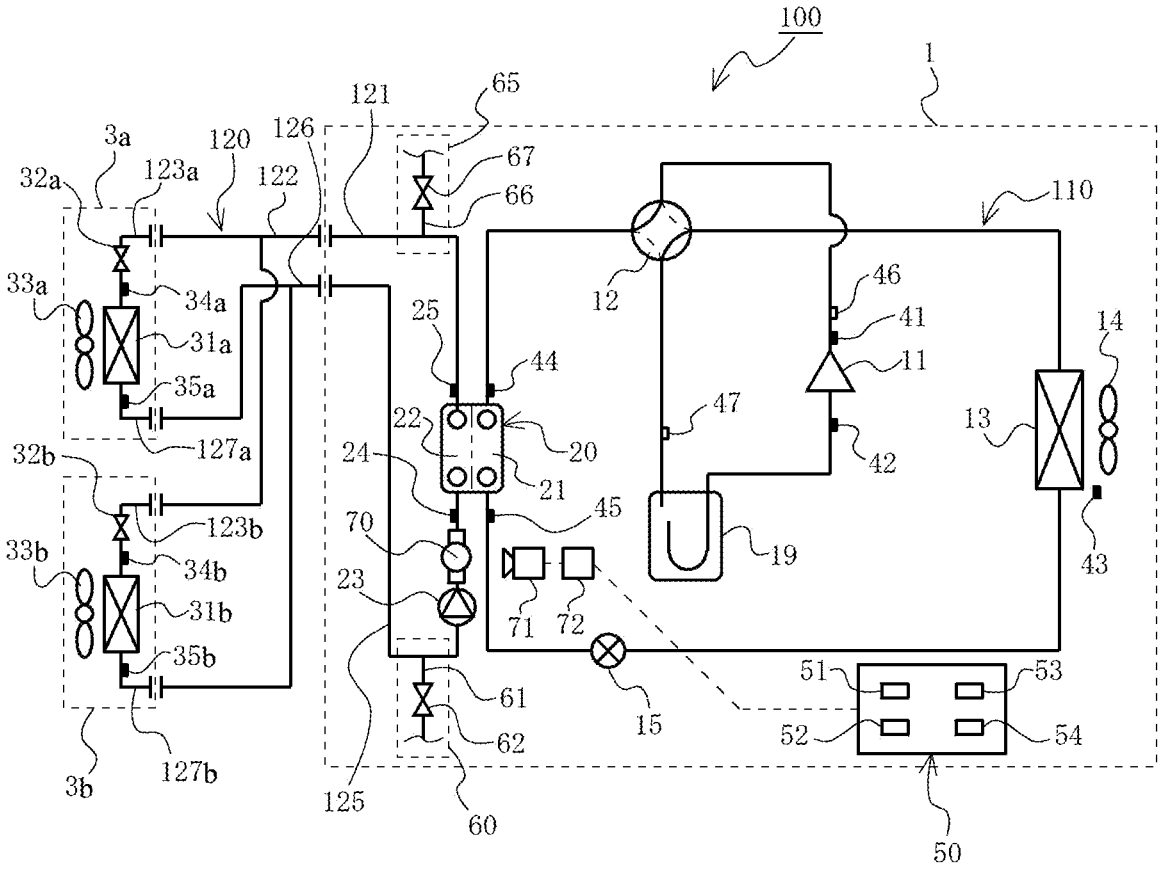
FIG. 8 schematically illustrates an exemplary circuit configuration of an air-conditioning apparatus according to Embodiment 4.

FIG. 8 schematically illustrates an exemplary circuit configuration of an air-conditioning apparatus according to Embodiment 4.

The heat-medium cycle circuit 120 of the air-conditioning apparatus 100 according to Embodiment 4 includes a window 70 configured to allow viewing of the heat medium inside the heat-medium cycle circuit 120. According to Embodiment 4, the window 70 is provided at the pipe 125 at a location near the discharge side of the pump 23. The window 70 is, for example, a sight glass. The air-conditioning apparatus 100 according to Embodiment 4 incudes a camera 71 configured to capture, through the window 70, an image of the heat medium inside the heat-medium cycle circuit 120, and an image processing device 72 configured to detect air bubbles from the image captured by the camera 71. The result of air bubble detection performed by the image processing device 72 is received by the receiving unit 52 of the controller 50.

In the air-conditioning apparatus 100 according to Embodiment 4, the operation mode switching unit 54 of the controller 50 is configured to, in response to the frequency of appearance of air bubbles becoming less than or equal to a predetermined frequency, determine that an air parcel present inside the heat-medium cycle circuit 120 has sufficiently dissolved into the heat medium. That is, at step S2 in FIG. 2, the operation-mode switching unit 54 determines to switch from the first operation mode to the second operation, after the frequency of appearance of air bubbles becomes less than or equal to a predetermined frequency. In other words, the controller 50 of the air-conditioning apparatus 100 according to Embodiment 4 switches from the first operation mode to the second operation mode after the frequency of appearance of air bubbles becomes less than or equal to a predetermined frequency.

In one example, the frequency of appearance of air bubbles represents the number of air bubbles detected per unit time. In this case, after the number of air bubbles detected per unit time becomes less than or equal to a predetermined number, the operation-mode switching unit 54 determines to switch from the first operation mode to the second operation mode. In another example, the frequency of appearance of air bubbles represents the amount of time from the last air bubble detection to the next air bubble detection. That is, the frequency of appearance of air bubbles is, for example, the interval of time between air bubble detections. In this case, after the interval of time between air bubble detections becomes greater than or equal to a predetermined time, the operation-mode switching unit 54 determines to switch from the first operation mode to the second operation mode.

Switching from the first operation mode to the second operation mode as described above also makes it possible to achieve an effect similar to that according to each of Embodiments 1 and 2, In one alternative example, the operator may visually observe air bubbles, and the observer may determine whether to switch from the first operation mode to the second operation mode. In this case, the air-conditioning apparatus 100 does not need to include the camera 71 and the image processing device 72. In another alternative example, the air-conditioning apparatus 100 configured to switch from the first operation mode to the second operation mode as described above with reference to Embodiments 1 to 3 may include the window 70. This is because such an arrangement makes it possible to visually check the state of the heat medium circulating in the heat-medium cycle circuit 120.

Embodiment 5

The determination at step S2 in FIG. 2 of whether to switch from the first process to the second process may be performed, for example, as in Embodiment 5 described below. In the following description of Embodiment 5, items not particularly mentioned below are assumed to be substantially similar to those according to one of Embodiments 1 to 4, and functions and features identical to those according to one of Embodiments 1 to 4 are denoted by the same reference signs hose used in the one of Embodiments 1 to 4.

Figure 9:
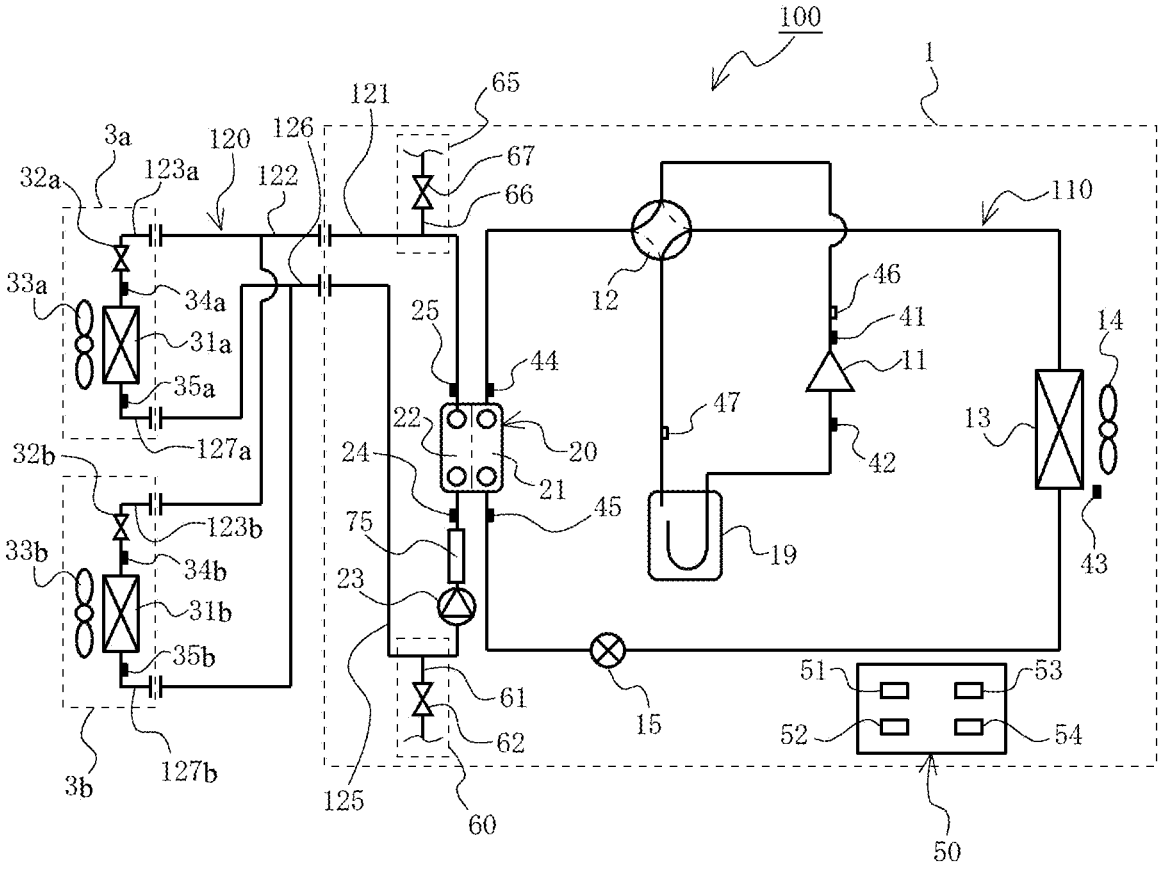
FIG. 9 schematically illustrates an exemplary circuit configuration of an air-conditioning apparatus according to Embodiment 5.

FIG. 9 schematically illustrates an exemplary circuit configuration of an air-conditioning apparatus according to Embodiment 5.

The air-conditioning apparatus 100 according to Embodiment 5 includes a detector 75, which is configured to detect the amount of air dissolved in the heat medium inside the heat-medium cycle circuit 120. The amount of air dissolved in the heat medium inside the heat-medium cycle circuit 120 will be hereinafter referred to as the amount of dissolved air. A known example of the above-mentioned detector is a detector including a sensor that detects the amount of oxygen dissolved in a heat medium. Such a detector uses a sensor employing an optical system or a membrane-covered electrode system to detect the amount of oxygen dissolved in a heat medium. For example, such a detector can be used as the detector 75. According to Embodiment 5, the detector 75 is provided at the pipe 125 at a location near the discharge side of the pump 23. The detector 75 may be fixed to the heat-medium cycle circuit 120, or may be removable from the heat-medium cycle circuit 120.

In the air-conditioning apparatus 100 according to Embodiment 5, the operation-mode switching unit 54 of the controller 50 is configured to, in response to the amount of dissolved air detected by the detector 75 becoming greater than or equal to a predetermined amount, determine that an air parcel present inside the heat-medium cycle circuit 120 has sufficiently dissolved into the heat medium. That is, at step S2 in FIG. 2, the operation-mode switching unit 54 determines to switch from the first operation mode to the second operation mode, after the amount of dissolved air detected by the detector 75 becomes greater than or equal to a predetermined amount. In other words, the controller 50 of the air-conditioning apparatus 100 according to Embodiment 5 switches from the first operation mode to the second operation mode after the amount of dissolved air detected by the detector 75 becomes greater than or equal to a predetermined amount.

Switching from the first operation mode to the second operation mode as described above also makes it possible to achieve an effect similar to that according to each of Embodiments 1 and 2. Alternatively, the operator may visually observe the result of the detection performed by the detector 75, and the operator may determine whether to switch from the first operation mode to the second operation mode.

REFERENCE SIGNS LIST

1: heat source unit, 3*a*, 3*b*; indoor unit, 11: compressor, 12: flow switching device, 13: heat source-side heat exchanger, 14: fan, 15: expansion device, 19: accumulator, 20: intermediate heat exchanger, 21: first heat transfer unit, 22: second heat transfer unit, 23: pump, 24: first temperature sensor, 25: second temperature sensor, 31*a*, 31*b*: use-side heat exchanger, 32*a*, 32*b*: flow control valve, 33*a*, 33*b*: fan, 34*a*, 34*b*: temperature sensor, 35*a*, 35*h*: temperature sensor, 36; first pressure sensor, 37: second pressure sensor, 41: temperature sensor, 42: temperature sensor, 43; temperature sensor, 44: temperature sensor, 45: temperature sensor, 46: pressure sensor, 47: pressure sensor, 50: controller, 51: input unit, 52: receiving unit, 53: control unit, 54: operation-mode switching unit, 60: supply mechanism, 61: supply pipe, 62: supply valve, 65: discharge mechanism, 66: discharge pipe, 67: discharge valve, 70: window, 71: camera, 72: image processing device, 75: detector, 100: air-conditioning apparatus, 110: refrigerant cycle circuit, 120: heat-medium cycle circuit, 121: pipe, 122: pipe, 123*a*, 123*b*: pipe, 125: pipe, 126: pipe, 127*a*, 127*b*: pipe.

The invention claimed is:

1. An air-conditioning apparatus comprising:

an intermediate heat exchanger including a first heat transfer unit in which refrigerant flows, and a second heat transfer unit in which a heat medium different from the refrigerant flows, the intermediate heat exchanger being configured to exchange heat between the first heat transfer unit and the second heat transfer unit;

a refrigerant cycle circuit including a heat source-side heat exchanger, the heat source-side heat exchanger being connected with the first heat transfer unit by a pipe, the refrigerant cycle circuit being configured to allow the refrigerant to circulate inside the refrigerant cycle circuit;

a heat-medium cycle circuit including a use-side heat exchanger, the use-side heat exchanger being connected with the second heat transfer unit by a pipe, the heat-medium cycle circuit being configured to allow the heat medium to circulate inside the heat-medium cycle circuit;

a discharge mechanism provided at the heat-medium cycle circuit and including a discharge valve, the discharge mechanism being configured to, when the discharge valve is open, discharge air present inside the heat-medium cycle circuit to an outside of the heat-medium cycle circuit;

a fan being configured to supply air to the use-side heat exchanger; and a controller configured to control activation and deactivation of the fan, wherein the air-conditioning apparatus is configured to execute a cooling operation in which the controller drives the fan to cool the air supplied to the use-side heat exchanger, a heating operation in which the controller drives the fan to heat the air supplied to the use-side heat exchanger, and an air discharge operation mode in which the air present inside the heat-medium cycle circuit is discharged to the outside of the heat-medium cycle circuit, the air discharge operation mode including a first operation mode, and a second operation mode performed after the first operation mode, wherein the first operation mode is an operation mode in which, with the heat source-side heat exchanger functioning as a radiator, and with the first heat transfer unit functioning as an evaporator, the refrigerant circulates in the refrigerant cycle circuit, with the discharge valve of the discharge mechanism being closed, the heat medium circulates in the heat-medium cycle circuit, and the controller deactivates the fan, and wherein the second operation mode is an operation mode in which, with the heat source-side heat exchanger functioning as an evaporator, and with the first heat transfer unit functioning as a radiator, the refrigerant circulates in the refrigerant cycle circuit, and with the discharge valve of the discharge mechanism being open, the heat medium circulates in the heat-medium cycle circuit.

2. The air-conditioning apparatus of claim 1, comprising a plurality of sets of the use-side heat exchanger and a flow control valve, the flow control valve being configured to control a flow rate at which the heat medium flows into the use-side heat exchanger, wherein the plurality of sets are connected in parallel with each other in the heat-medium cycle circuit, and wherein with only one of a plurality of the flow control valves being open, operation in the air discharge operation mode is performed for each of the plurality of sets.

3. The air-conditioning apparatus of claim 1, comprising:

a first temperature sensor configured to detect a temperature of the heat medium entering the second heat transfer unit of the intermediate heat exchanger; and a second temperature sensor configured to detect a temperature of the heat medium exiting the second heat transfer unit of the intermediate heat exchanger;

wherein the controller is configured to switch from the first operation mode to the second operation mode after a temperature difference decreases and a change of the temperature difference per unit time becomes less than or equal to a predetermined value, the temperature difference being obtained by subtracting a temperature detected by the second temperature sensor from a temperature detected by the first temperature sensor.

4. The air-conditioning apparatus of claim 1, wherein the heat-medium cycle circuit includes a pump configured to circulate the heat medium inside the heat-medium cycle circuit, wherein the air-conditioning apparatus comprises a first pressure sensor configured to detect a pressure of the heat medium discharged from the pump, and a second pressure sensor configured to detect a pressure of the heat medium entering the pump, wherein the controller is configured to switch from the first operation mode to the second operation mode after a pressure difference decreases and a change of the pressure difference per unit time becomes less than or equal to a predetermined value, the pressure difference being obtained by subtracting a pressure detected by the second pressure sensor from a pressure detected by the first pressure sensor.

5. The air-conditioning apparatus of claim 1, comprising:

a detector configured to detect an amount of dissolved air, the amount of dissolved air being an amount of the air that is dissolved in the heat medium inside the heat-medium cycle circuit;

wherein the controller is configured to switch from the first operation mode to the second operation mode after the amount of dissolved air detected by the detector becomes greater than or equal to a predetermined amount.

6. The air-conditioning apparatus of claim 1, wherein the heat-medium cycle circuit includes a window configured to allow viewing of the heat medium inside the heat-medium cycle circuit, wherein the air-conditioning apparatus comprises a camera configured to capture, through the window, an image of the heat medium inside the heat-medium cycle circuit, an image processing device configured to detect an air bubble from the image captured by the camera, and a controller configured to switch the air discharge operation mode from the first operation mode to the second operation mode, and wherein the controller is configured to switch from the first operation mode to the second operation mode after a frequency of appearance of the air bubble becomes less than or equal to a predetermined frequency.

7. The air-conditioning apparatus of claim 1, wherein the heat-medium cycle circuit includes a window configured to allow viewing of the heat medium inside the heat-medium cycle circuit.

8. An air discharge method for an air-conditioning apparatus, the air-conditioning apparatus including an intermediate heat exchanger including a first heat transfer unit in which refrigerant flows, and a second heat transfer unit in which a heat medium different from the refrigerant flows, the intermediate heat exchanger being configured to exchange heat between the first heat transfer unit and the second heat transfer unit, a refrigerant cycle circuit including a heat source-side heat exchanger, the heat source-side heat exchanger being connected with the first heat transfer unit by a pipe, the refrigerant cycle circuit being configured to allow the refrigerant to circulate inside the refrigerant cycle circuit, a heat-medium cycle circuit including a use-side heat exchanger, the use-side heat exchanger being connected with the second heat transfer unit by a pipe, the heat-medium cycle circuit being configured to allow the heat medium to circulate inside the heat-medium cycle circuit, a discharge mechanism provided at the heat-medium cycle circuit and including a discharge valve, the discharge mechanism being configured to, when the discharge valve is open, discharge air present inside the heat-medium cycle circuit to an outside of the heat-medium cycle circuit, a fan being configured to supply air to the use-side heat exchanger, and a controller configured to control activation and deactivation of the fan, wherein the air-conditioning apparatus is configured to execute a cooling operation in which the controller drives the fan to cool the air supplied to the use-side heat exchanger, and a heating operation in which the controller drives the fan to heat the air supplied to the use-side heat exchanger, the air discharge method for the air-conditioning apparatus being a method for discharging the air present inside the heat-medium cycle circuit to the outside of the heat-medium cycle circuit, the air discharge method comprising a first process, and a second process performed after the first process, wherein the first process is a process of, with the heat source-side heat exchanger functioning as a radiator, and with the first heat transfer unit functioning as an evaporator, circulating the refrigerant in the refrigerant cycle circuit, with the discharge valve of the discharge mechanism being closed, circulating the heat medium in the heat-medium cycle circuit, and the controller deactivating the fan, and wherein the second process is a process of, with the heat source-side heat exchanger functioning as an evaporator, and with the first heat transfer unit functioning as a radiator, circulating the refrigerant in the refrigerant cycle circuit, and with the discharge valve of the discharge mechanism being open, circulating the heat medium in the heat-medium cycle circuit.

9. The air discharge method of claim 8, wherein the air-conditioning apparatus includes a plurality of sets of the use-side heat exchanger and a flow control valve, the flow control valve being configured to control a flow rate at which the heat medium flows into the use-side heat exchanger, wherein the plurality of sets are connected in parallel with each other in the heat-medium cycle circuit, and wherein the air discharging method comprises, with only one of a plurality of the flow control valves being open, performing the first process and the second process for each of the plurality of sets.

10. The air discharge method of claim 8, comprising switching from the first process to the second process after a temperature difference decreases and a change of the temperature difference per unit time becomes less than or equal to a predetermined value, the temperature difference being obtained by subtracting a temperature of the heat medium exiting the second heat transfer unit of the intermediate heat exchanger from a temperature of the heat medium entering the second heat transfer unit.

11. The air discharge method of claim 8, wherein the heat-medium cycle circuit includes a pump configured to circulate the heat medium inside the heat-medium cycle circuit, and wherein the air discharge method comprises switching from the first process to the second process after a pressure difference decreases and a change of the pressure difference per unit time becomes less than or equal to a predetermined value, the pressure difference being obtained by subtracting a pressure of the heat medium entering the pump from a pressure of the heat medium discharged from the pump.

12. The air discharge method of claim 8, comprising switching from the first process to the second process after an amount of dissolved air becomes greater than or equal to a predetermined amount, the amount of dissolved air being an amount of the air that is dissolved in the heat medium inside the heat-medium cycle circuit.

13. The air discharge method of claim 8, wherein the heat-medium cycle circuit includes a window configured to allow viewing of the heat medium inside the heat-medium cycle circuit, and wherein the air discharge method comprises switching from the first process to the second process after a frequency of appearance of an air bubble seen through the window becomes less than or equal to a predetermined frequency.

14. The air-conditioning apparatus of claim 7, comprising a controller configured to switch from the first operation mode to the second operation mode based on the view of the heat medium through the window.

15. The air discharge method of claim 8, further comprising:

wherein the heat-medium cycle circuit includes a window configured to allow viewing of the heat medium inside the heat-medium cycle circuit, and wherein the air discharge method comprises switching from the first process to the second process based on the view of the heat medium through the window.

* * * * *